US007488194B2

(12) United States Patent
Hall et al.

(10) Patent No.: US 7,488,194 B2
(45) Date of Patent: Feb. 10, 2009

(54) DOWNHOLE DATA AND/OR POWER TRANSMISSION SYSTEM

(76) Inventors: David R. Hall, 2185 S. Larsen Pkwy., Provo, UT (US) 84606; Scott Dahlgren, 2185 S. Larsen Pkwy., Provo, UT (US) 84606; Joe Fox, 2185 S. Larsen Pkwy., Provo, UT (US) 84606; Tyson J. Wilde, 2185 S. Larsen Pkwy., Provo, UT (US) 84606; Paul M. Schramm, 2185 S. Larsen Pkwy., Provo, UT (US) 84606; Jonathan Marshall, 2185 S. Larsen Pkwy., Provo, UT (US) 84606

( * ) Notice: Subject to any disclaimer, the term of this patent is extended or adjusted under 35 U.S.C. 154(b) by 141 days.

(21) Appl. No.: 11/428,445

(22) Filed: Jul. 3, 2006

(65) Prior Publication Data

US 2008/0003856 A1 Jan. 3, 2008

(51) Int. Cl.
*H01R 4/60* (2006.01)

(52) U.S. Cl. ..... 439/191; 439/271

(58) Field of Classification Search ..... 439/191, 439/199, 201, 271, 275, 278, 281
See application file for complete search history.

(56) References Cited

U.S. PATENT DOCUMENTS

| | | | |
|---|---|---|---|
| 2,000,716 | A | 5/1935 | Folk |
| 2,301,783 | A | 11/1942 | Lee |
| 2,414,719 | A | 1/1947 | Cloud |
| 3,253,248 | A | 5/1966 | Brandt |
| 3,967,201 | A | 6/1976 | Rorden |
| 4,012,092 | A | 3/1977 | Godbey |
| 4,039,237 | A | 8/1977 | Cullen |
| 4,176,894 | A | 12/1979 | Godbey |
| 4,416,494 | A | 11/1983 | Watkins |
| 4,591,226 | A | 5/1986 | Hargett |
| 4,660,910 | A | 4/1987 | Sharp |
| 4,785,247 | A | 11/1988 | Meador |
| 4,806,928 | A | 2/1989 | Veneruso |
| 5,337,002 | A | 8/1994 | Mercer |
| 6,223,826 | B1 | 5/2001 | Chau |
| 6,367,564 | B1 | 4/2002 | Mills |
| 6,392,317 | B1 | 5/2002 | Hall |
| 6,402,524 | B2 | 6/2002 | Wurm |
| 6,446,728 | B2 | 9/2002 | Chau |

(Continued)

OTHER PUBLICATIONS

U.S. Appl. No. 11/133,905, filed May 21, 2005, David R. Hall.

*Primary Examiner*—Hien Vu
(74) *Attorney, Agent, or Firm*—Tyson J. Wilde; Benjamin T. Miskin

(57) ABSTRACT

An apparatus has a downhole tubular body having a bore with a central axis. An electrical conductor assembly is disposed within the bore of the tubular component, the assembly having a first end, a second end, a first conductor, and a second conductor electrically isolated from the first conductor. At least one end of the assembly has a polished mating surface which has an electrically conductive portion surrounded by a dielectric material. The electrically conductive portion is in electrical communication with the first conductor. The first and second ends of the electrical conductor assembly are substantially aligned to the central axis of the bore by stabilizing elements within the bore.

24 Claims, 21 Drawing Sheets

U.S. PATENT DOCUMENTS

| | | | |
|---|---|---|---|
| 6,651,755 | B1 | 11/2003 | Kelpe |
| 6,655,464 | B2 | 12/2003 | Chau |
| 6,670,880 | B1 | 12/2003 | Hall |
| 6,717,501 | B2 | 4/2004 | Hall |
| 6,739,413 | B2 | 5/2004 | Sharp |
| 6,799,632 | B2 | 10/2004 | Hall |
| 6,821,147 | B1 | 11/2004 | Hall |
| 6,830,467 | B2 | 12/2004 | Hall |
| 6,844,498 | B2 | 1/2005 | Hall |
| 6,845,822 | B2 | 1/2005 | Chau |
| 6,888,473 | B1 | 5/2005 | Hall |
| 6,913,093 | B2 | 7/2005 | Hall |
| 6,929,493 | B2 | 8/2005 | Hall |
| 6,945,802 | B2 | 9/2005 | Hall |
| 6,968,611 | B2 | 11/2005 | Hall |
| 7,028,779 | B2 | 4/2006 | Chau |
| 7,150,329 | B2 | 12/2006 | Chau |
| 2004/0104797 | A1 | 6/2004 | Hall |
| 2004/0113808 | A1 | 6/2004 | Hall |
| 2004/0145492 | A1 | 7/2004 | Hall |
| 2004/0150532 | A1 | 8/2004 | Hall |
| 2004/0164833 | A1 | 8/2004 | Hall |
| 2004/0164838 | A1 | 8/2004 | Hall |
| 2004/0216847 | A1 | 11/2004 | Hall |
| 2004/0244916 | A1 | 12/2004 | Hall |
| 2004/0244964 | A1 | 12/2004 | Hall |
| 2004/0246142 | A1 | 12/2004 | Hall |
| 2005/0001735 | A1 | 1/2005 | Hall |
| 2005/0001736 | A1 | 1/2005 | Hall |
| 2005/0001738 | A1 | 1/2005 | Hall |
| 2005/0035874 | A1 | 2/2005 | Hall |
| 2005/0035875 | A1 | 2/2005 | Hall |
| 2005/0035876 | A1 | 2/2005 | Hall |
| 2005/0036507 | A1 | 2/2005 | Hall |
| 2005/0039912 | A1 | 2/2005 | Hall |
| 2005/0045339 | A1 | 3/2005 | Hall |
| 2005/0046586 | A1 | 3/2005 | Hall |
| 2005/0046590 | A1 | 3/2005 | Hall |
| 2005/0067159 | A1 | 3/2005 | Hall |
| 2005/0070144 | A1 | 3/2005 | Hall |
| 2005/0082092 | A1 | 4/2005 | Hall |
| 2005/0092499 | A1 | 5/2005 | Hall |
| 2005/0093296 | A1 | 5/2005 | Hall |
| 2005/0095827 | A1 | 5/2005 | Hall |
| 2005/0115717 | A1 | 6/2005 | Hall |
| 2005/0145406 | A1 | 7/2005 | Hall |
| 2005/0150653 | A1 | 7/2005 | Hall |
| 2005/0161215 | A1 | 7/2005 | Hall |
| 2005/0173128 | A1 | 8/2005 | Hall |
| 2005/0212530 | A1 | 9/2005 | Hall |
| 2005/0236160 | A1 | 10/2005 | Hall |
| 2005/0284662 | A1 | 12/2005 | Hall |

DOWNHOLE DATA AND/OR POWER TRANSMISSION SYSTEM

BACKGROUND OF THE INVENTION

The present invention relates to the field of data and/or power transmission. More specifically, it relates to the field of apparatus for transmitting data and/or power through such downhole tool strings.

Downhole tool strings have become increasingly versatile in the last half century. In addition to traditional oil, gas, and geothermic exploration and production purposes, tubular tool strings are often used for what is known as horizontal directional drilling to install underground power lines, communication lines, water lines, sewer lines, and gas lines. This sort of downhole drilling is particularly useful for boring underneath roadways, waterways, populated areas, and environmentally protected areas.

The increased versatility of downhole drilling with tool strings has led to a higher demand for apparatus that are able to transmit a power signal to downhole equipment as well as transmit data between downhole and surface Tools. Hence, several different approaches to solving the problem of transmitting an electrical signal across the joints of a tool string have been developed and are known in the art.

U.S. Pat. Nos. 6,670,880; 6,982,384; and 6,929,493 to Hall, all of which are incorporated herein by reference for all that they disclose, teach of a system wherein tubular components are directly or inductively coupled at threaded joints in the tool string. Other downhole telemetry systems are disclosed in U.S. Pat. No. 6,688,396 to Floerke et al and U.S. Pat. No. 6,641,434 to Boyle et al, which are also herein incorporated by reference for all that they contain.

Optimally, a system for transmitting data and/or power between surface equipment and downhole tools in a tool string maintains a level of abstraction to the point where it is transparent to the tool string operator or crew, as time delays introduced by a complicated telemetry system may represent a significant amount of money.

BRIEF SUMMARY OF THE INVENTION

In one aspect of the present invention, an apparatus comprises a downhole tubular body which comprises a bore having a central axis. The tubular body may be a drill pipe, a drill collar, a sub, a horizontal drill pipe, a reamer, production pipe, injection pipe, upset drill pipe, or a combination thereof.

An electrical conductor assembly having a first end, a second end, a first conductor, and a second conductor electrically insulated from the first conductor is disposed within the bore of the tubular component. At least one end of the assembly has a polished mating surface, which may be flat and hard, comprising an electrically conductive portion surrounded by an insulating material such as alumina, ferrite, another metal oxides, polycrystalline diamond, carbon, or combinations thereof. The first electrical conductor is in communication with the electrically conductive portion of the mating surface, and may be coupled to the electrically conductive portion by an electrically conductive interface. The interface may be intermediate the mating surface and the first electrical conductor and covered by an electrical insulator. The second electrical conductor may be in electrical communication with the tubular body. The mating surface may also comprise a dimple or a junk slot.

In some embodiments, the mating surface may be concave, convex, or non-planar. The mating surface may also comprise a larger diameter than a remainder of the electrical conductor assembly. In embodiments where the mating surface comprises a second concentric electrically conducting portion, said portion may be in electrical communication with a third electrical conductor. The electrically conductive portion is in electrical communication with the first conductor and may comprise a material such as tungsten carbide, beryllium copper, cemented metal carbide, hardened steel, gold or gold coated materials or a combination thereof.

The electrical conductor assembly may comprise a coaxial cable, a pair of twisted wires, a biaxial cable, a triaxial cable, insulated copper wires, or combinations thereof. The electrical conductor assembly may comprise a stainless steel armoring, and the armoring may be flared on at least one end. At least one seal may be intermediate the armoring and the dielectric material. The armoring may be held in tension within the tubular component, and the mating surface may be spring-loaded. The first electrical conductor may be in electrical communication with a power and/or data source.

The first and second ends of the electrical conductor assembly are substantially aligned to the central axis of the bore by stabilizing elements within the bore. These stabilizing elements, which may include fins, rings, wave springs, rods, bristles, beads, blocks, whiskers, plates and combinations thereof, may be attached to a collar surrounding the electrical conductor assembly. The stabilizing elements may also be attached directly to the electrical conductor assembly and be under an axially compressive load.

In another aspect of the invention, a system comprises first and second tubular bodies coupled together by mating threads and aligned to a common central axis. Each tubular body has a bore and an electrical conductor assembly disposed within the bore of the tubular component. Each electrical conductor assembly may comprise a first and a second electrical conductor. Each first electrical conductor may be in electrical communication with a power or data source, and each second electrical conductor may be in electrical communication with its respective tubular body. At least one end of each assembly has a polished mating surface comprising an electrically conductive portion surrounded by a dielectric material. In some embodiments, each assembly comprises a mating surface at both the first and second ends. The mating surface of the electrical conductor assembly in the first tubular component substantially engages the mating surface of the electrical conductor assembly in the second electrical conductor assembly. The mating surfaces may be engaged at a compressive load, such as a spring load, of at least 200 psi. The first and second ends of the electrical conductor assembly are substantially aligned to the central axis of the bore by stabilizing elements within the bore such as fins, whiskers, rings, wave springs, rods, bristles, beads, blocks, plates, and combinations thereof.

DETAILED DESCRIPTION OF THE INVENTION AND THE PREFERRED EMBODIMENT

Figure 1:
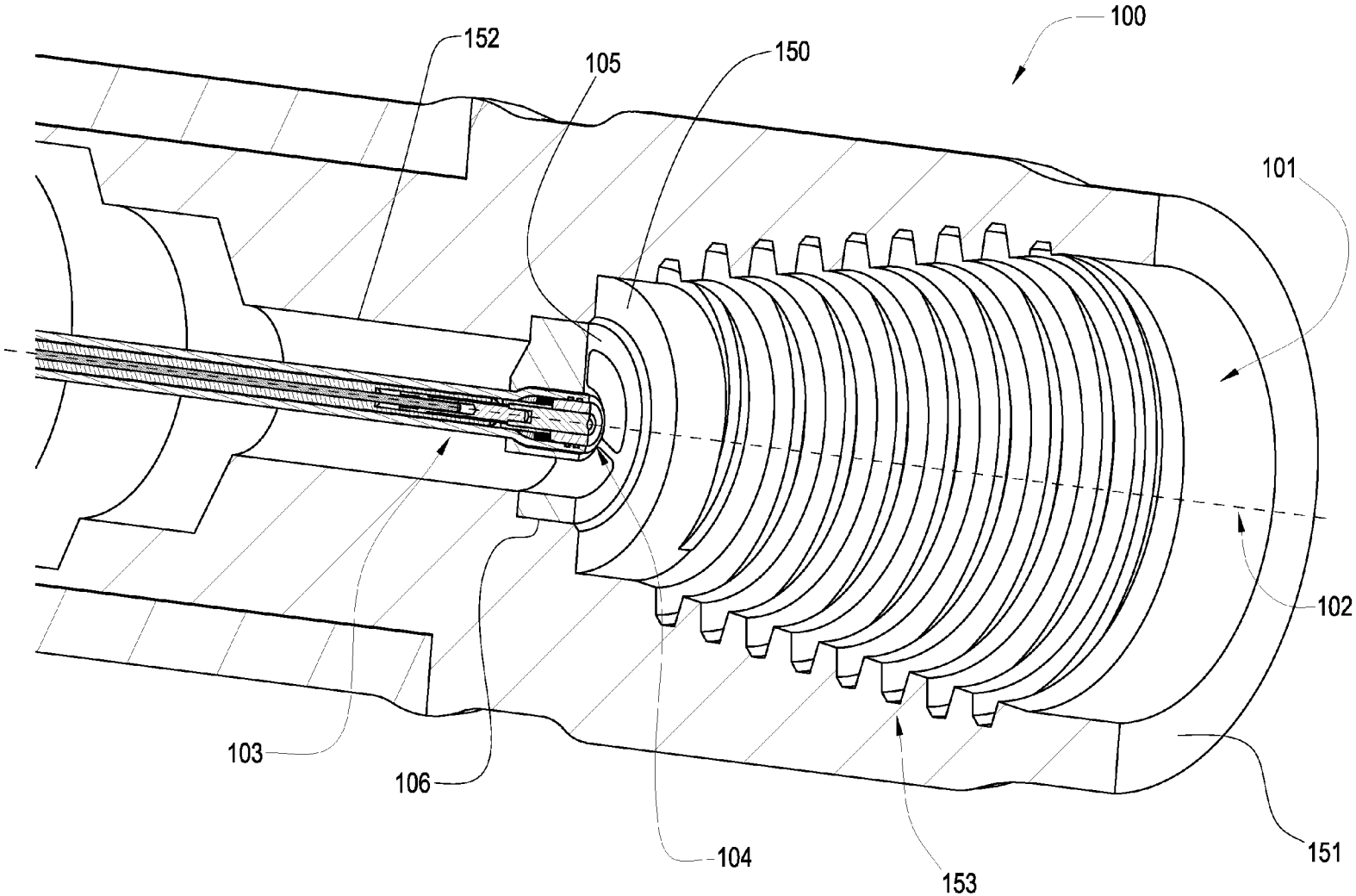
FIG. 1 is a cross-sectional diagram of an embodiment of an electrical conductor assembly disposed within an end of a tubular body.

Referring now to FIG. 1, a tubular body 100 comprises a bore 101 having a central axis 102. The tubular body 100 shown is a drill pipe, but in other embodiments may be a drill collar, a sub, a horizontal drill pipe, a reamer, a production pipe, an injection pipe, an upset drill pipe, or a combination thereof.

The tubular body 100 comprises an electrical conductor assembly 103 disposed within the bore 101. The electrical conductor assembly 103 comprises a mating surface 104 which may engage with a similar mating surface in a separate tubular body. The electrical conductor assembly may be configured to transmit an electrical signal, such as a power or data signal, from one end to another end. The electrical conductor assembly 103 is substantially aligned at its end to the central axis 102 by a stabilizing element 105. By substantially aligning the electrical conductor assembly 103 to the central axis 102, another electrical conductor assembly 103 in a second tubular body (see FIG. 4) aligned to the same axis 102 may be coupled to the electrical conductor assembly at the mating surface 104 to allow the transmission of the electrical signal from one tubular body 100 to another. The stabilizing element 105 may be adapted to fit within a groove 106 formed in the tubular body 100. The groove 160 may be formed in an inner shoulder 150, outer shoulder 151 of the tool joint, or it may be formed in the inner diameter 152 of the tubular body. A threadform 111 may be disposed between the inner and outer shoulders. In other embodiments a liner may be disposed within the tubular body and the stabilizing element is attached to the liner.

Figure 2:
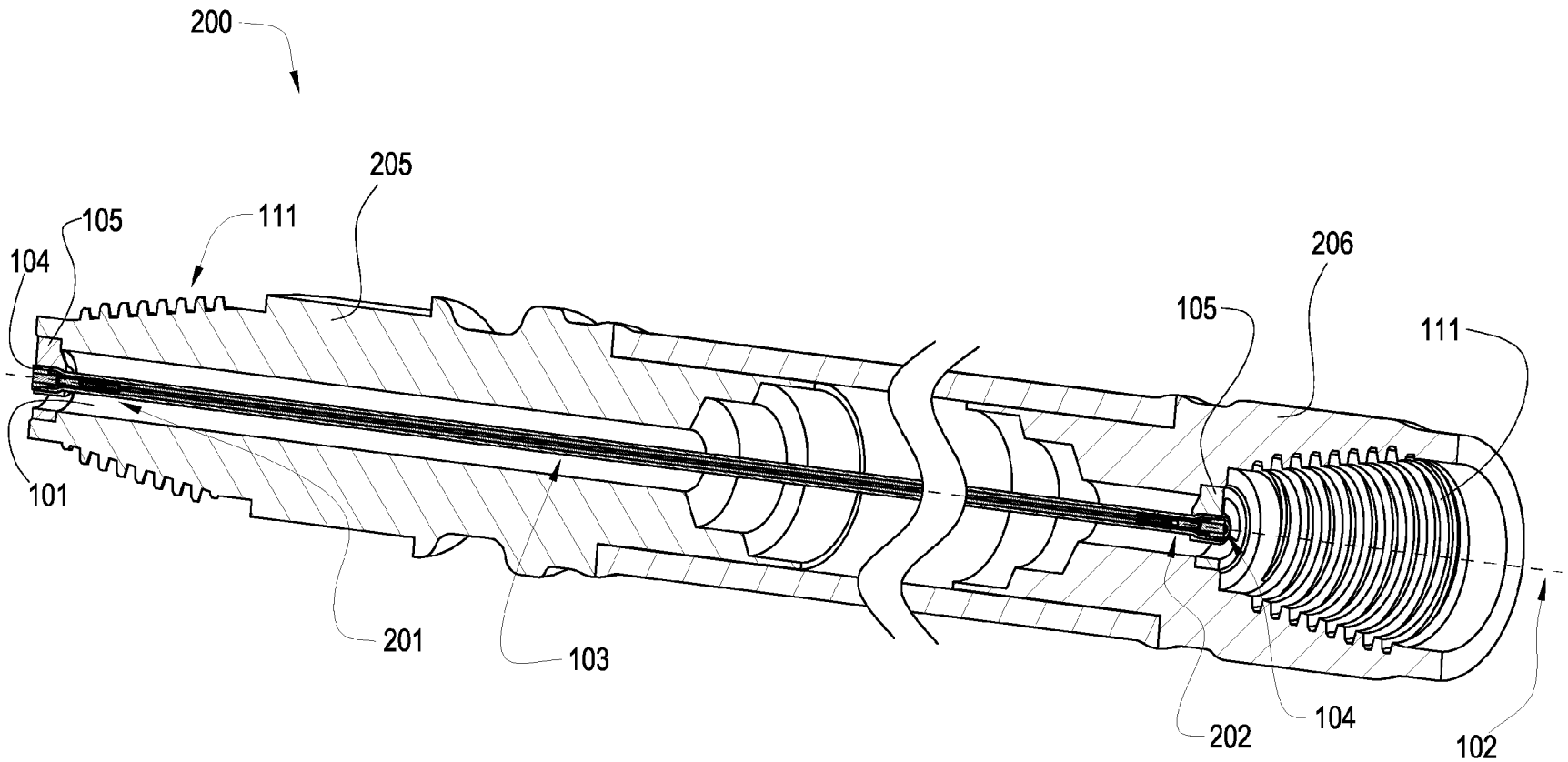
FIG. 2 is a cross-sectional diagram of another embodiment of an electrical conductor assembly disposed within a tubular body.

Referring now to FIG. 2, a tubular body 200 may comprise an electrical conductor assembly 103 with a first end 201 disposed within a first end 205 of the tubular body 200. A second end 202 of the conductor assembly 103 may be disposed within a second end 206 of the tubular body 200.

Figure 3:
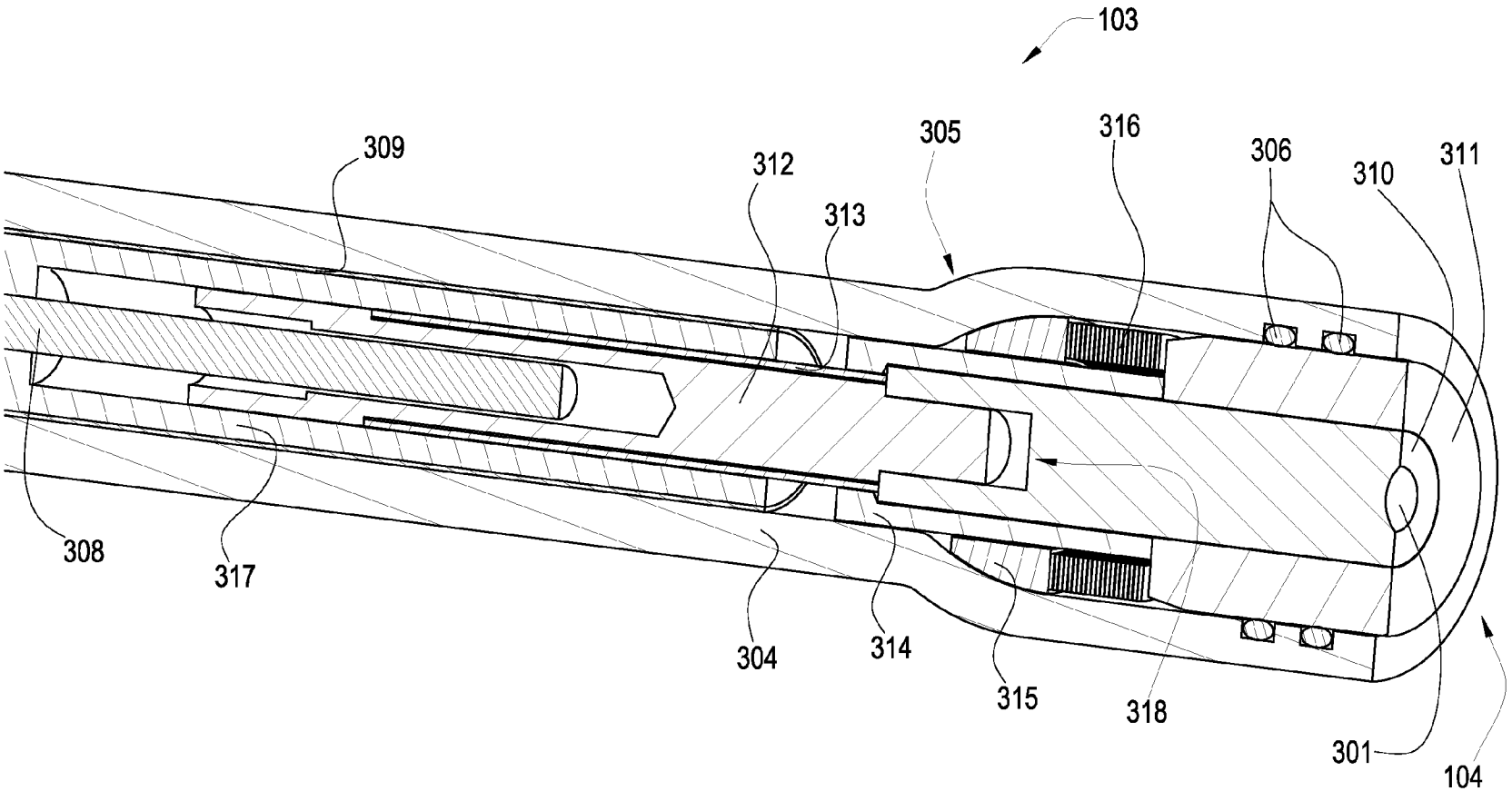
FIG. 3 is a cross-sectional diagram of an embodiment of an electrical conductor assembly.
Figure 4:
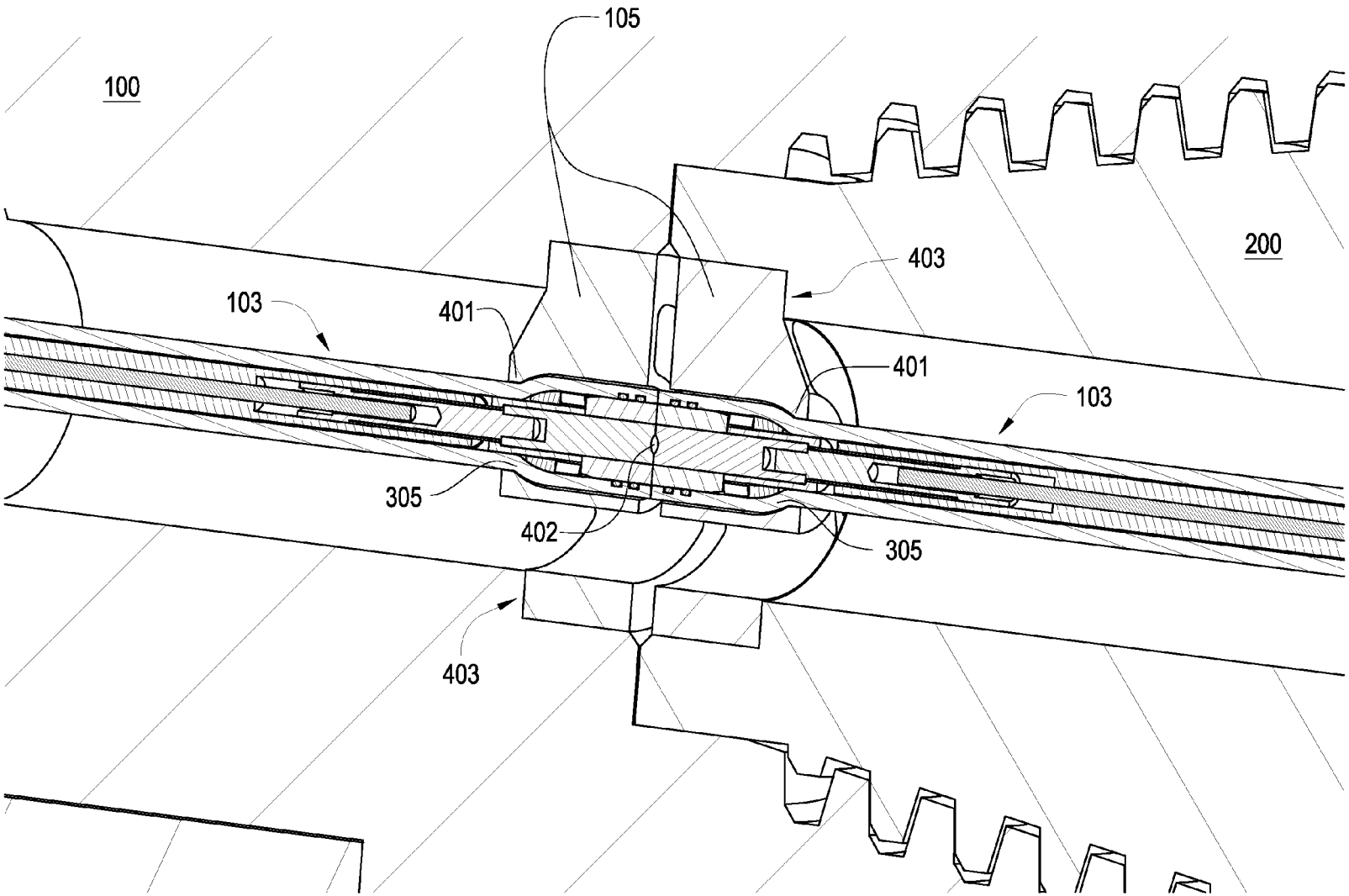
FIG. 4 is a cross-sectional diagram of an embodiment of mated electrical conductor assemblies disposed within two tubular bodies.

Referring now to FIGS. 3-4, a preferred electrical conductor assembly 103 is shown in greater detail. The electrical assembly 103 comprises a first conductor 308 such as the inner conductor of a coaxial cable and a second conductor 309 such as the outer conductor of a coaxial cable. The second conductor 309 is electrically isolated from the first conductor 308, in this case by an insulator 317 in the coaxial cable. In other embodiments the first and second conductors 308, 309 may be a pair of twisted wires, a biaxial cable, a triaxial cable, insulated copper wires, or combinations thereof. The conductor assembly 103 further comprises an armoring 304 preferably made from stainless steel. The armoring 304 may protect the conductor assembly 103 from corrosive downhole fluids and/or mechanical damage.

The mating surface 104 of the electrical conductor assembly 103 comprises an electrically conductive portion 310 surrounded by a dielectric material 311. The electrically conductive portion 310 may be tungsten carbide. In other embodiments it may comprise beryllium copper, cemented metal carbide, hardened steel, and/or combinations thereof. The dielectric material 311 may comprise a ceramic such as alumina or an oxide of Mg, Al, Si, Yb, Ca, Be, Sr, Nd, Sm, Er, Eu, Sc, La, Gd, Dy, or Tm. In other embodiments it may comprise ferrite, polycrystalline diamond, or carbon. Preferably the mating surface 104 formed by the electrically conductive portion 310 and the dielectric material 311 is polished and forms a very hard, very flat surface. Under these conditions, when a particulate is caught intermediate two mating surfaces it is believed that the particulate will be crushed or pushed out of the way due to the fact that the mating surfaces 104 comprise material that is much harder than the particulate. The mating surface 104 may comprise a dimple 301 for the accumulation of debris.

The first electrical conductor 308 is in electrical communication with the electrically conductive portion 310. An electrically conductive interface 312 may couple the first electrical conductor 308 to the electrically conductive portion 310. The electrically conductive interface 312 may be covered by an electrical insulator 313 such as a heat shrink material such as PEEK or PEKK. Additionally, a protective electrical insulator 314 may cover a portion of the electrically conductive portion 310 and electrically conductive interface 312 to prevent any short circuit between the inner conductor and the outer conductor. The first conductor 308 may be in electrical communication with a data or power source, and the second conductor 309 may provide a return path to ground.

Resilient material 316 such as a plurality of wave springs may be disposed between the dielectric material 311 and a thrust shoulder 315 anchored against a flaring 305 of the stainless steel armoring 304. The flaring 305 may serve at least two purposes: as the aforementioned anchoring apparatus and also to permit the mating surface 104 to have a larger diameter than the remainder of the electrical conductor assembly 103. The resilient material 316 may spring-load the mating surface 104 to allow a sufficient axial load in a mated connection as to permit good connectivity between the electrically conductive portions 310 of two electrical conductor assemblies 103. In some embodiments, the spring-load may comprise a compressive load of 200 psi or greater. Seals 306 such as O-rings may be disposed intermediate the armoring 304 and the dielectric material 311 to prevent undesirable fluids from entering the inner structure of the conductor assembly 103.

By mating two tubular bodies 100, 200 together an electrical signal may be transmitted from one electrical conductor assembly 103 to another. The electrical conductor assemblies 103 may have their mating surfaces 104 sufficiently aligned by stabilizing elements 105 to allow electrical communication between the electrically conductive portions 310 of the conductor assemblies 103. The stabilizing elements may be situated within annular grooves 403 of the tubular bodies 100, 200 and anchor the electrical conductor assemblies 103 under an axial load. The stabilizing elements 105 may comprise shoulders 401 against which the flaring 305 of the armoring 304 may rest. The axial load may be a result of holding the electrical conductor assemblies 103 in axial tension within the tubular component. The two dimples 301 may provide a cavity 402 for the accumulation of junk or debris at the interface of the mating surfaces 104. The mating surface may be set free to orient itself with the other mating surface.

As the armoring 304 may be in electrical communication with the second conductor 309, the stabilizing elements 105 may be in electrical communication with their respective tubular bodies 100, 200. Since the second conductor 309 is preferably tied to ground and the first and second tubular bodies 100, 200 may be in electrical communication with each other through their mechanical joint, an entire tool string may be connected to ground and provide a good return path for an electrical signal transmitted through the first conductor 308. This may serve as a preemptive solution to problems that may arise from floating ground issues.

Figure 5:
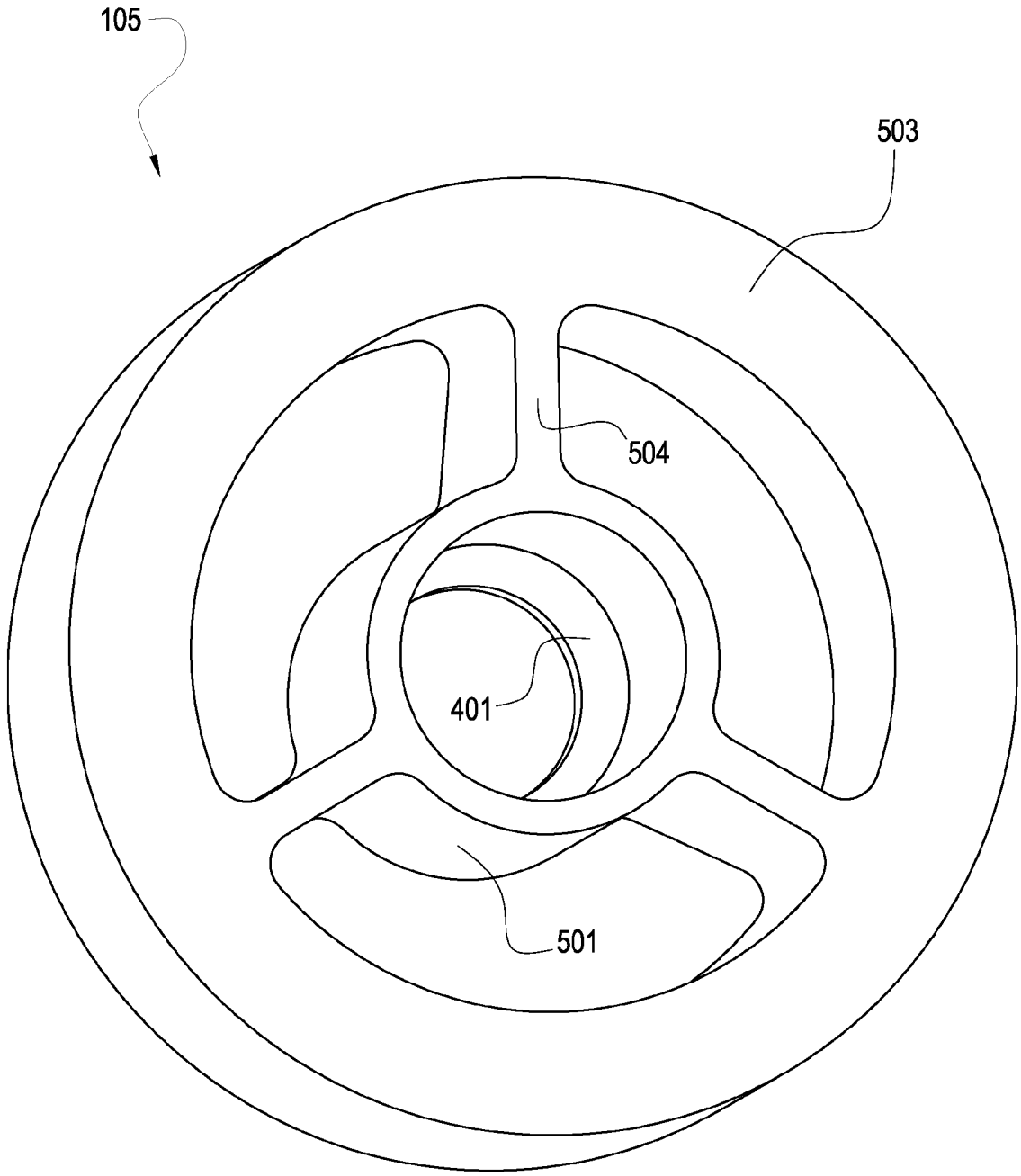
FIG. 5 is a perspective diagram of an embodiment of a stabilizing element.

Referring now to FIG. 5, a perspective diagram of a preferred stabilizing element 105 is shown. The stabilizing element 105 may comprise a collar 501 designed to surround and attach directly to the electrical conductor assembly 103. As previously mentioned, the shoulder 401 is configured to hold the flaring 305 of the armoring 304. An outer ring 503 may anchor the stabilizing element inside of the tubular body 100. Fins 504 may connect the collar to the outer ring while still permitting the passage of fluid through the stabilizing element 105. In other embodiments the stabilizing elements may comprise wave springs, rods, bristles, beads, blocks, whiskers, plates, and combinations thereof. In some embodiments of the present invention, the electrical conductor assembly 103 may be threaded into the collar. In other embodiments, a portion of the collar may first be secured against the shoulder 401 and a then the electrical conductor assembly 103 may be secured within the collar by attaching the remaining removable portion of the collar to the secured portion of the collar.

Figure 6:
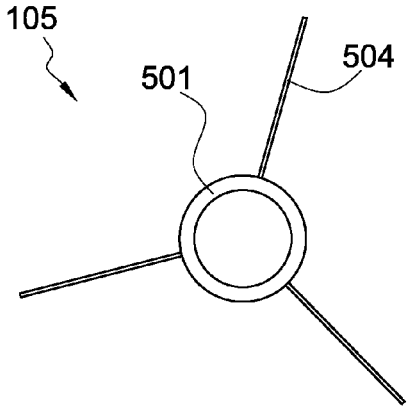
FIG. 6 is a cross-sectional diagram of another embodiment of a stabilizing element.
Figure 7:
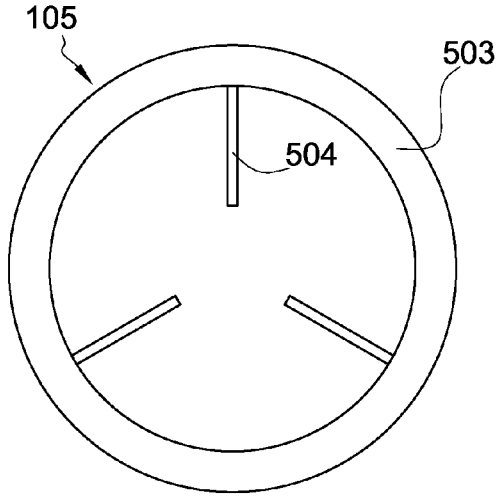
FIG. 7 is a cross-sectional diagram of another embodiment of a stabilizing element.
Figure 8:
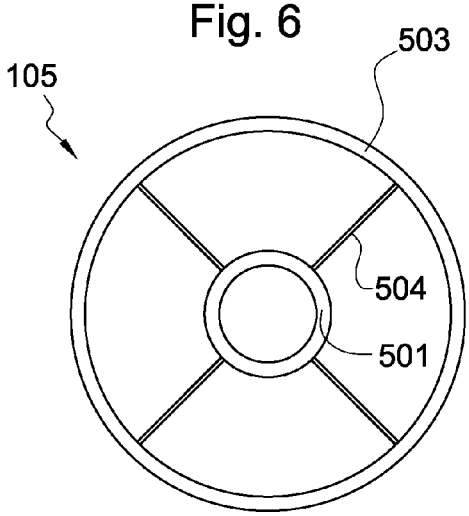
FIG. 8 is a cross-sectional diagram of another embodiment of a stabilizing element.
Figure 9:
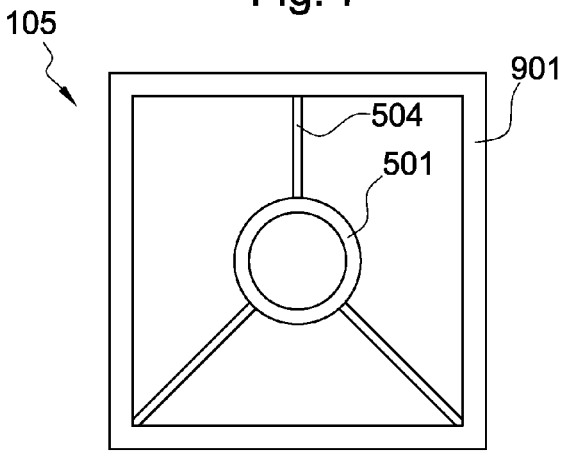
FIG. 9 is a cross-sectional diagram of another embodiment of a stabilizing element.
Figure 10:
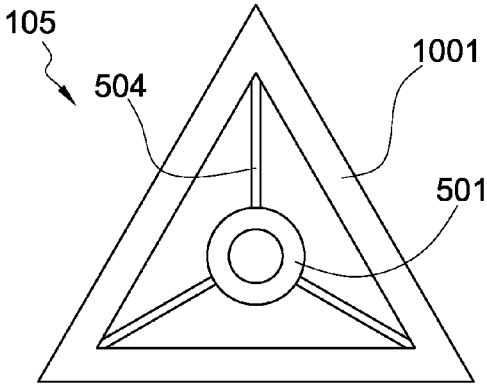
FIG. 10 is a cross-sectional diagram of another embodiment of a stabilizing element.
Figure 11:
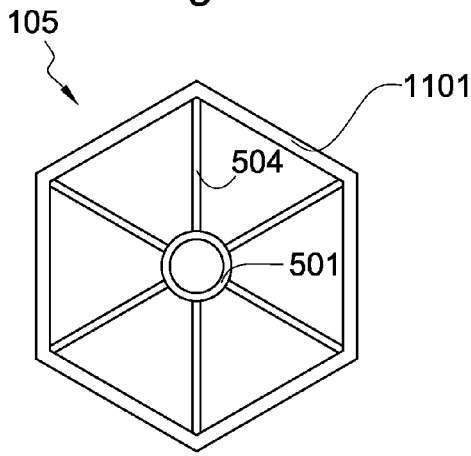
FIG. 11 is a cross-sectional diagram of another embodiment of a stabilizing element.

Referring now to FIGS. 6-11, various embodiments of stabilizing elements 105 incorporating radial fins 504 are shown. In FIG. 6 the fins 504 extend from a collar 501 to the inner diameter of the tubular body 100. In FIG. 7 the fins 504 extend from an outer ring 503 to the electrical conductor assembly 103. FIG. 8 shows a stabilizing element 105 with four fins 504. FIG. 9 shows a stabilizing element 105 with a four-sided outer anchor 901 and FIG. 10 shows a triangular outer anchor 1001. FIG. 11 shows a stabilizing element 105 with a hexagonal outer anchor 1101.

Figure 12:
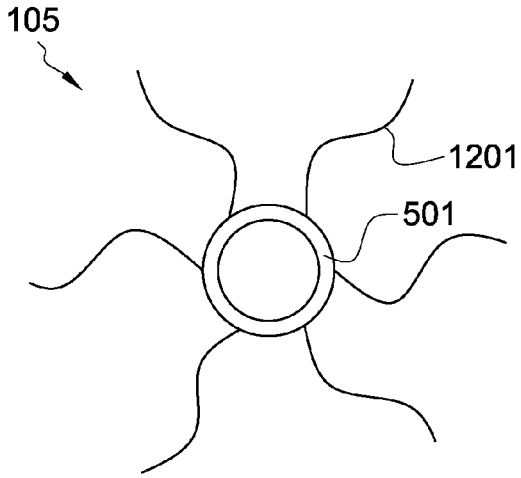
FIG. 12 is a cross-sectional diagram of another embodiment of a stabilizing element.
Figure 13:
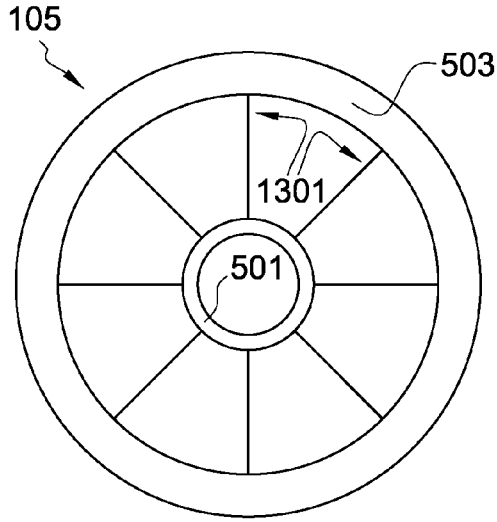
FIG. 13 is a cross-sectional diagram of another embodiment of a stabilizing element.
Figure 14:
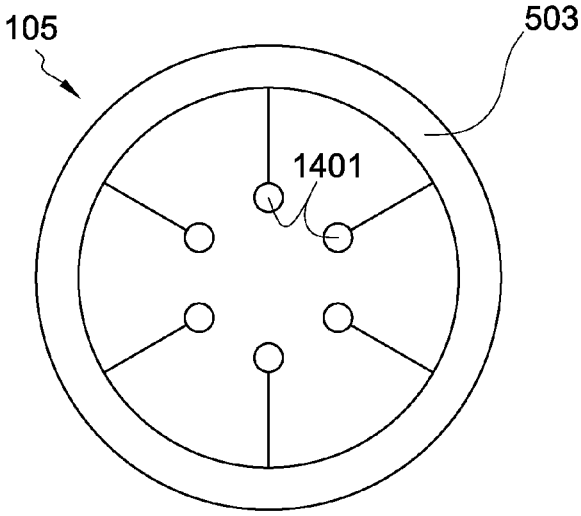
FIG. 14 is a cross-sectional diagram of another embodiment of a stabilizing element.
Figure 15:
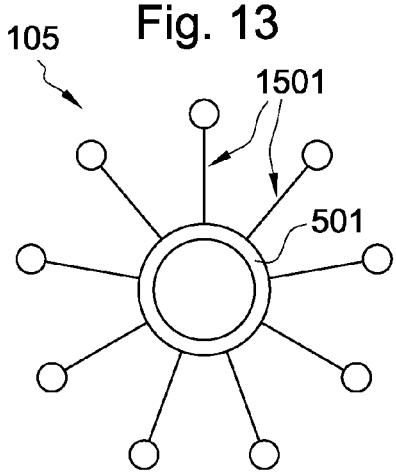
FIG. 15 is a cross-sectional diagram of another embodiment of a stabilizing element.
Figure 16:
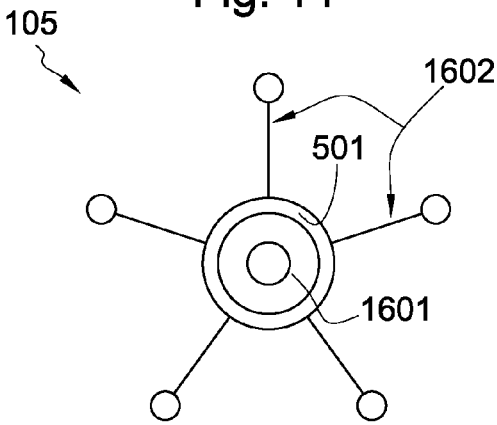
FIG. 16 is a cross-sectional diagram of another embodiment of a stabilizing element.
Figure 17:
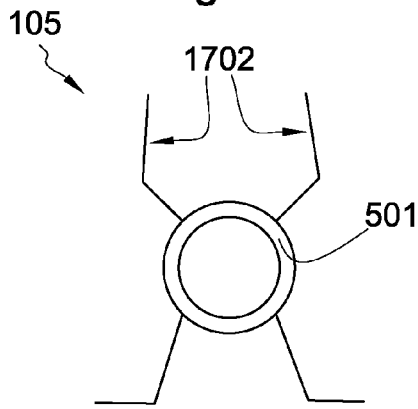
FIG. 17 is a cross-sectional diagram of another embodiment of a stabilizing element.

Referring to FIGS. 12-17, other embodiments of stabilizing elements 105 comprising resilient spokes are shown. In FIG. 12 the spokes 1201 extend radially from the collar 501 in a wavelike geometry. FIG. 13 shows a "wagon wheel" type configuration in which spokes 1301 extend radially from the collar 501 to an outer ring 503. FIG. 14 shows an embodiment in which beaded spokes 1401 extend from the outer ring 503 to the conductor assembly 103. In FIG. 15 beaded spokes 1501 extend outward from the collar 501 to the inner diameter of the tubular body 100. The embodiment of FIG. 16 comprises a resilient material 1601 intermediate the collar 501 and the conductor assembly 103 with beaded spokes 1602 extending outward from the collar 501. FIG. 17 shows an embodiment with bent spokes 1702 extending from the collar 501 to the inner diameter of the tubular component. The bend in the spokes 1702 may provide a spring constant and aid in anchoring the electrical conductor assembly 103 within the tubular body 100.

Figure 18:
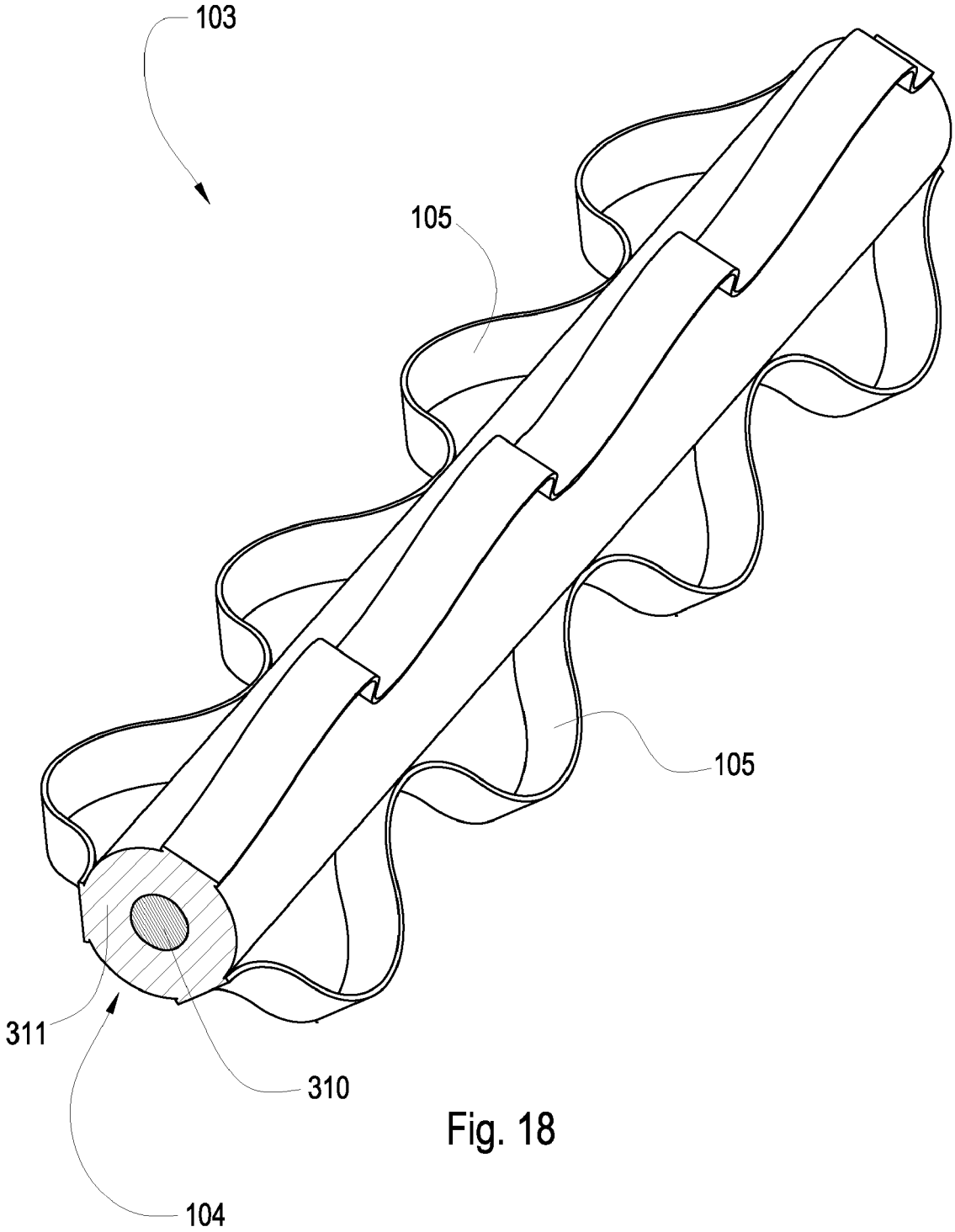
FIG. 18 is a cross-sectional diagram of an embodiment of an electrical conductor assembly and stabilizing elements.

Referring now to FIG. 18, in another embodiment of the invention stabilizing elements 105 may be attached directly to an electrical conductor assembly 103. The stabilizing elements 105 may comprise substantially sinusoidal strips of metal disposed along the outer circumference of the electrical conductor assembly.

Figure 19:
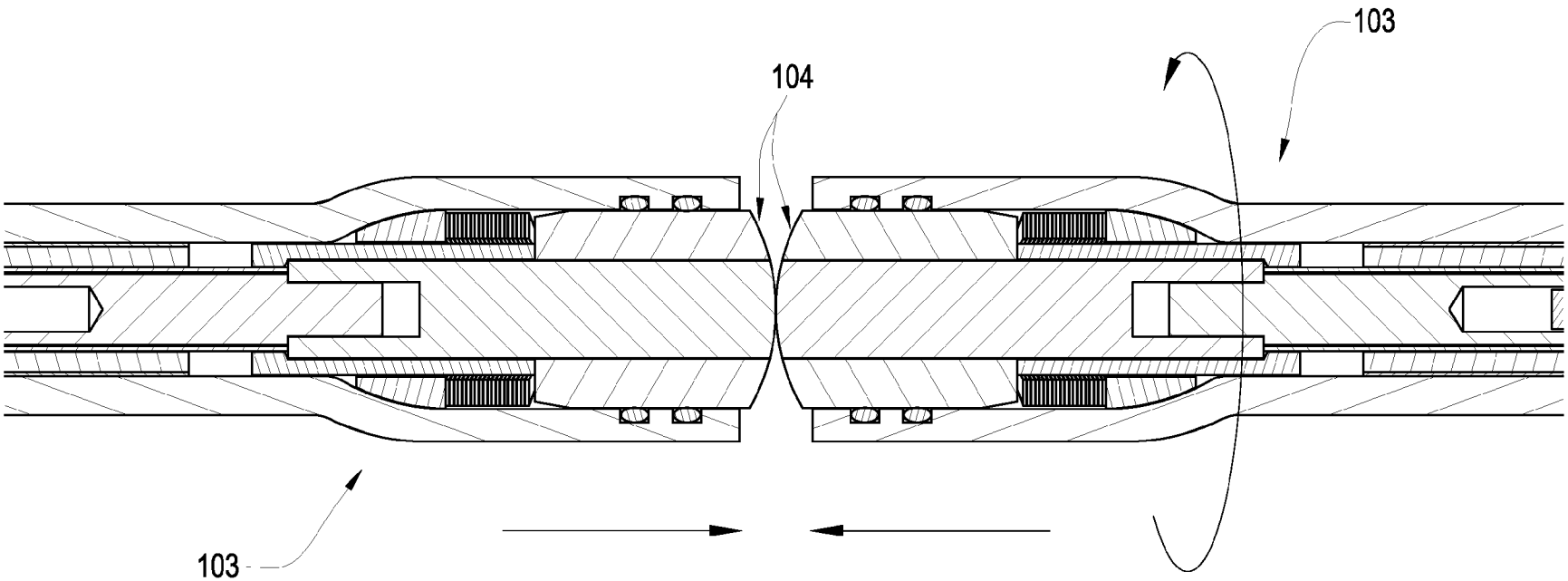
FIG. 19 is a cross-sectional diagram of another embodiment of mated electrical conductor assemblies.

Referring now to FIG. 19, an embodiment of the invention includes electrical conductor assemblies 103 with convex mating surfaces 104. When the mating surfaces 104 are brought together in this configuration, their convex shape allows particulates or debris between the surfaces 104 to be expelled from the interface between the electrically conductive portions 310. As indicated by the arrows, one advantage of the current invention is that mated electrical conductor assemblies 103 may be axially rotated with respect to each other and still maintain electrical connectivity.

Figure 20:
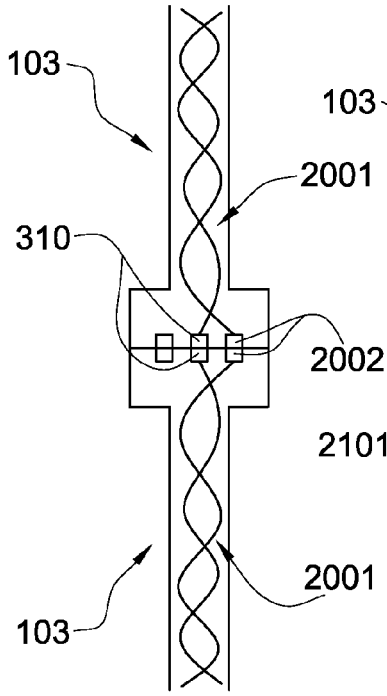
FIG. 20 is a cross-sectional diagram of another embodiment of mated electrical conductor assemblies.
Figure 21:
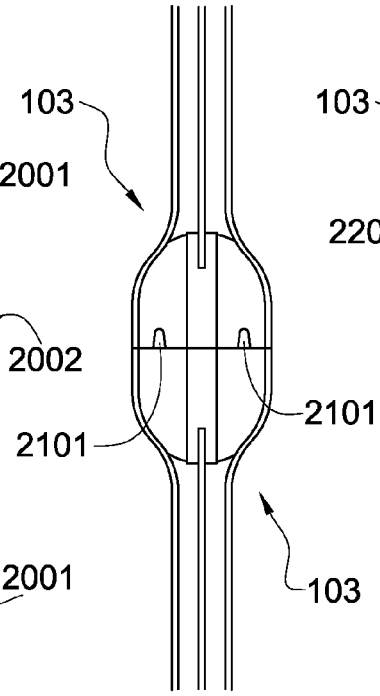
FIG. 21 is a cross-sectional diagram of another embodiment of mated electrical conductor assemblies.
Figure 22:
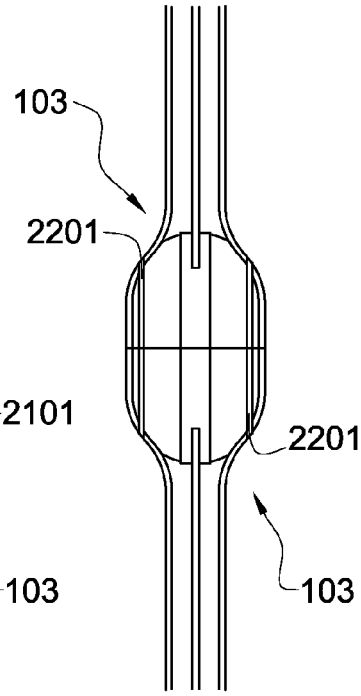
FIG. 22 is a cross-sectional diagram of another embodiment of mated electrical conductor assemblies.
Figure 23:
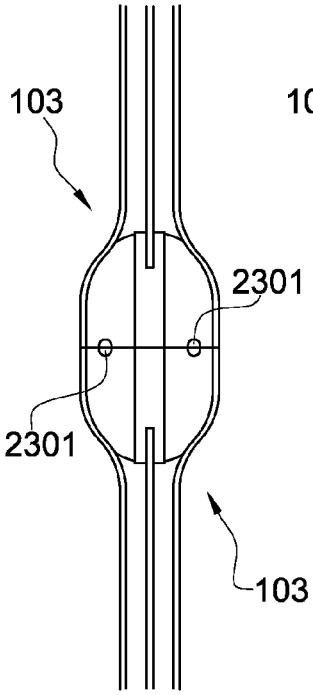
FIG. 23 is a cross-sectional diagram of another embodiment of mated electrical conductor assemblies.
Figure 24:
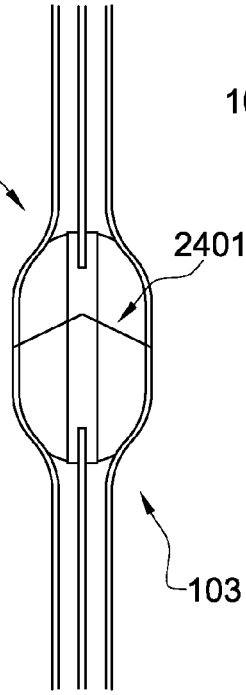
FIG. 24 is a cross-sectional diagram of another embodiment of mated electrical conductor assemblies.
Figure 25:
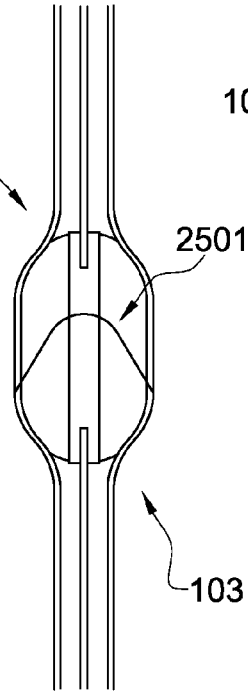
FIG. 25 is a cross-sectional diagram of another embodiment of mated electrical conductor assemblies.
Figure 26:
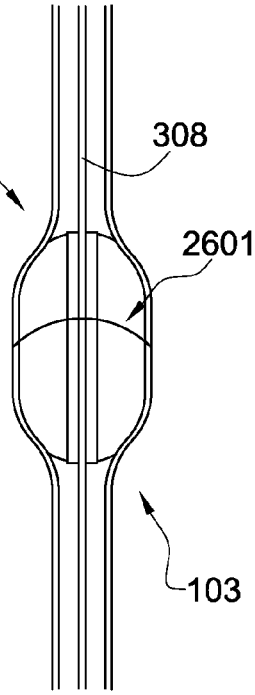
FIG. 26 is a cross-sectional diagram of another embodiment of mated electrical conductor assemblies.

Referring now to FIGS. 20-26, different geometries of mating surfaces 104 in mated electrical conductor assemblies 103 are shown. FIG. 20 shows a mating surface having two electrically conductive portions 310, 2002 connected to a twisted pair of wire 2001. FIG. 21 shows a pair of mated electrical conductor assemblies 103 with one of the mating surfaces 104 comprising an annular groove 2101 that may be used as a junk slot to capture debris. In FIG. 22, both of the mating surfaces 104 comprise two slots 2201 through which debris and fluid may flow. FIG. 23 shows a pair of mated electrical conductor assemblies 103 in which both mating surfaces have an annular junk slot 2301. FIGS. 24-26 show various interfaces 2401, 2501, 2601 between mating surfaces 104 of the male/female type. FIG. 26 discloses a first conductor 308 (see FIG. 3) that extends all the way to the mating surface.

Figure 27:
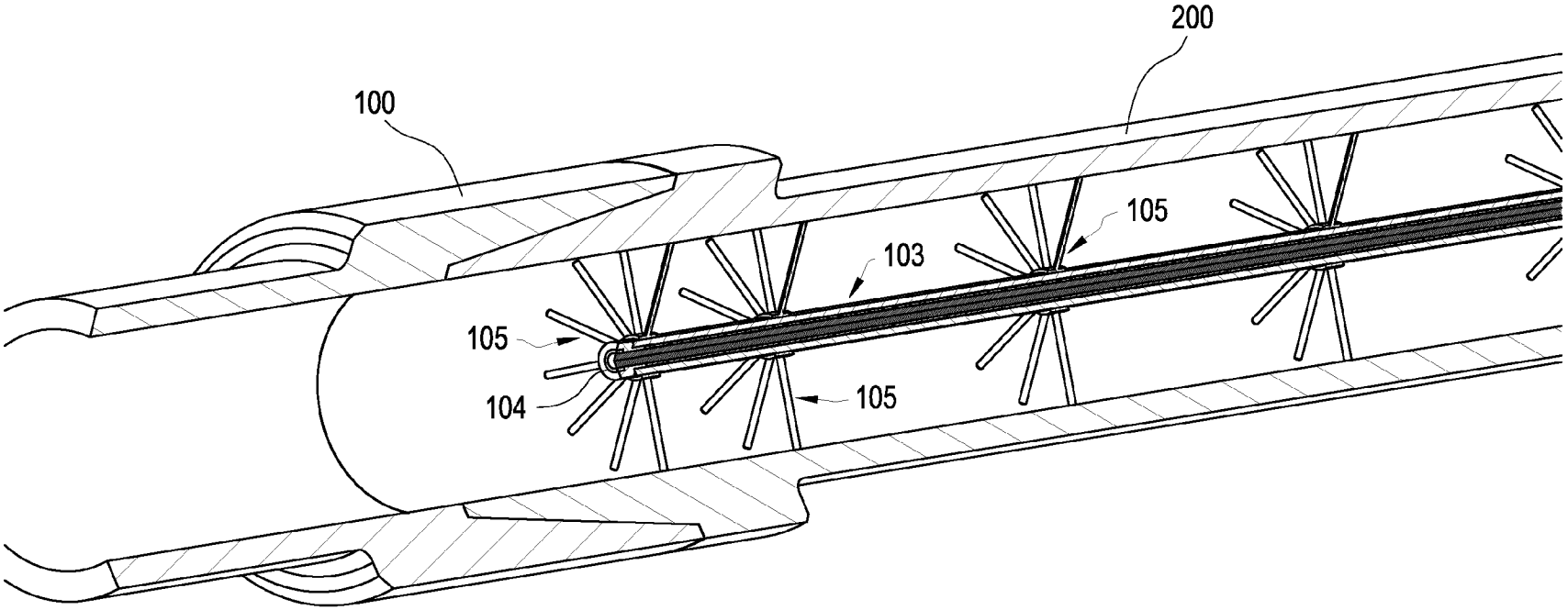
FIG. 27 is a cross-sectional diagram of another embodiment of an electrical conductor assembly disposed within an end of a tubular body.
Figure 28:
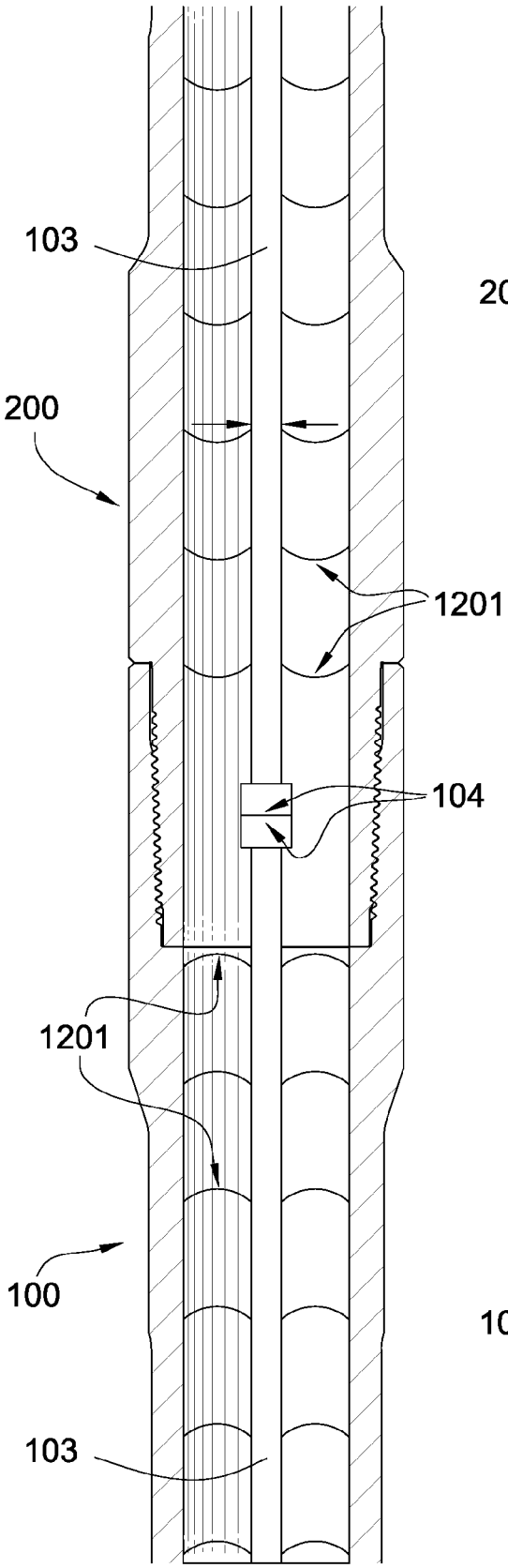
FIG. 28 is a cross-sectional diagram of another embodiment of mated electrical conductor assemblies disposed within two tubular bodies.
Figure 29:
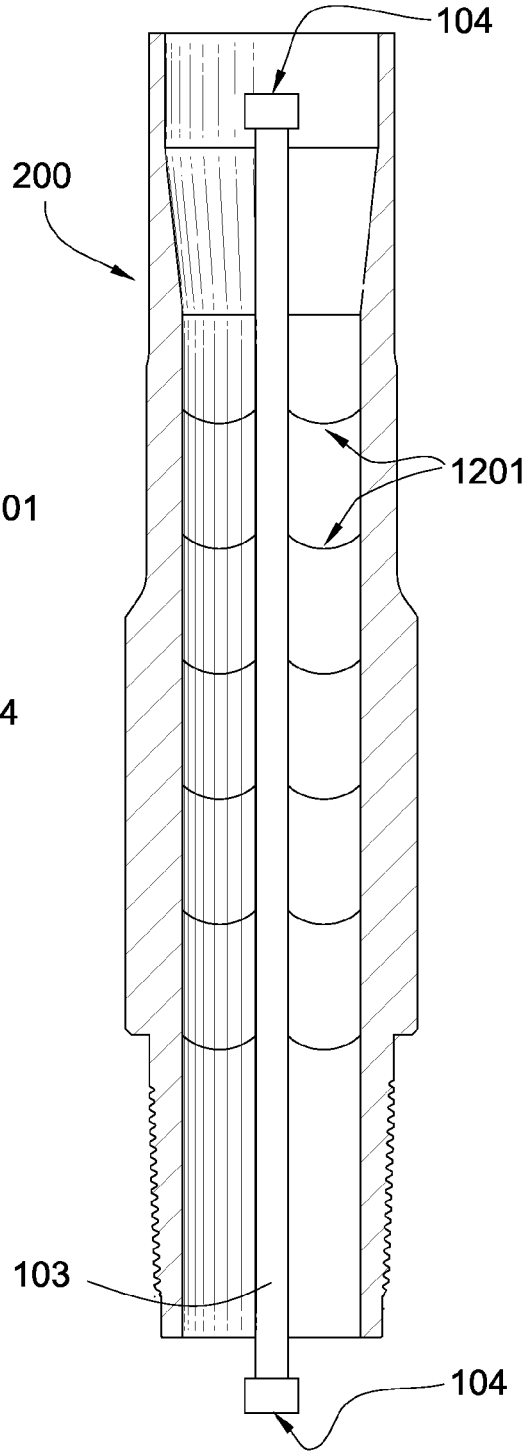
FIG. 29 is a cross-sectional diagram of another embodiment of an electrical conductor assembly disposed within a single tubular body.

Referring now to FIG. 27 an electrical conductor assembly 103 is shown disposed within a tubular body 200 with stabilizing elements 105 of the whisker variety. In this embodiment, the entire electrical conductor assembly may be in compression in facilitate a good connection at the mating surface. The stabilizing elements may be used to control buckling of the electrical conductor assembly. Any of the stabilizing elements described above which may substantially align the mating surfaces to a central axis of the tubular body may also be used to control the buckling the electrical conductor assembly. In FIG. 28, the electrical conductor assembly 103 of FIG. 27 is shown mated to another similar electrical conductor assembly 103 disposed within another tubular body 100. The stabilizing elements 105 may be under an axial load as the two mating surfaces are pressed together. FIG. 29 shows a similar embodiment disposed within a tubular body 200 with an upset inner bore. In this sort of tubular component 200 whiskers used as stabilizing elements 105 may be flexible to provide stabilization both in the upset region and the end regions of the inner diameter of the tubular body 200.

Figure 30:
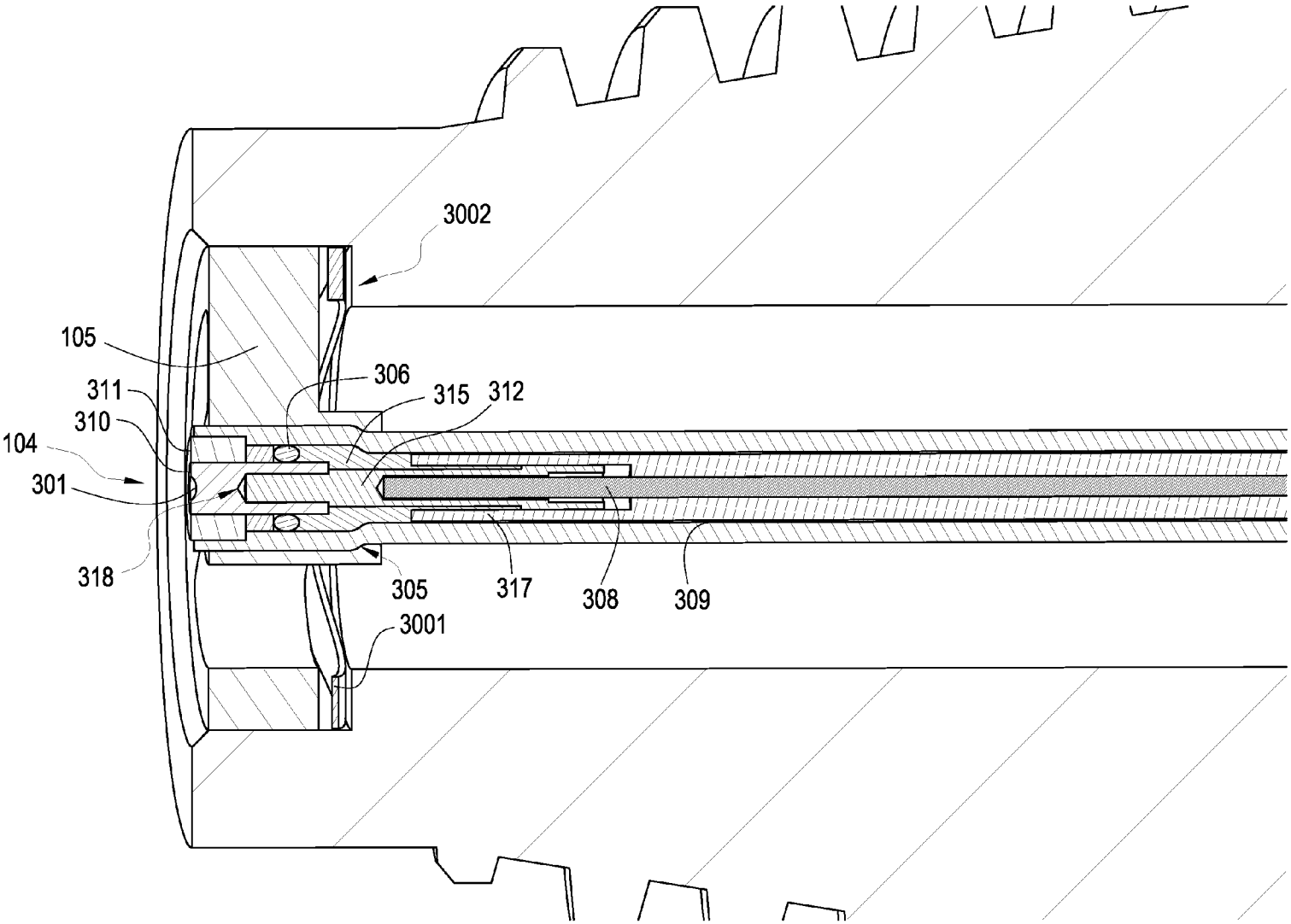
FIG. 30 is a cross-sectional diagram of another embodiment of an electrical conductor assembly disposed within an end of a tubular body.

Referring now to FIG. 30, a stabilizing element 105 may be used in conjunction with a resilient material 3001 such as a wave spring against a shoulder 3002 of the tubular body 200 to provide a spring-loaded mating surface 104. In this embodiment it may not be necessary to include a resilient element in the electrical conductor assembly 103 to spring-load the mating surface 104.

Figure 31:
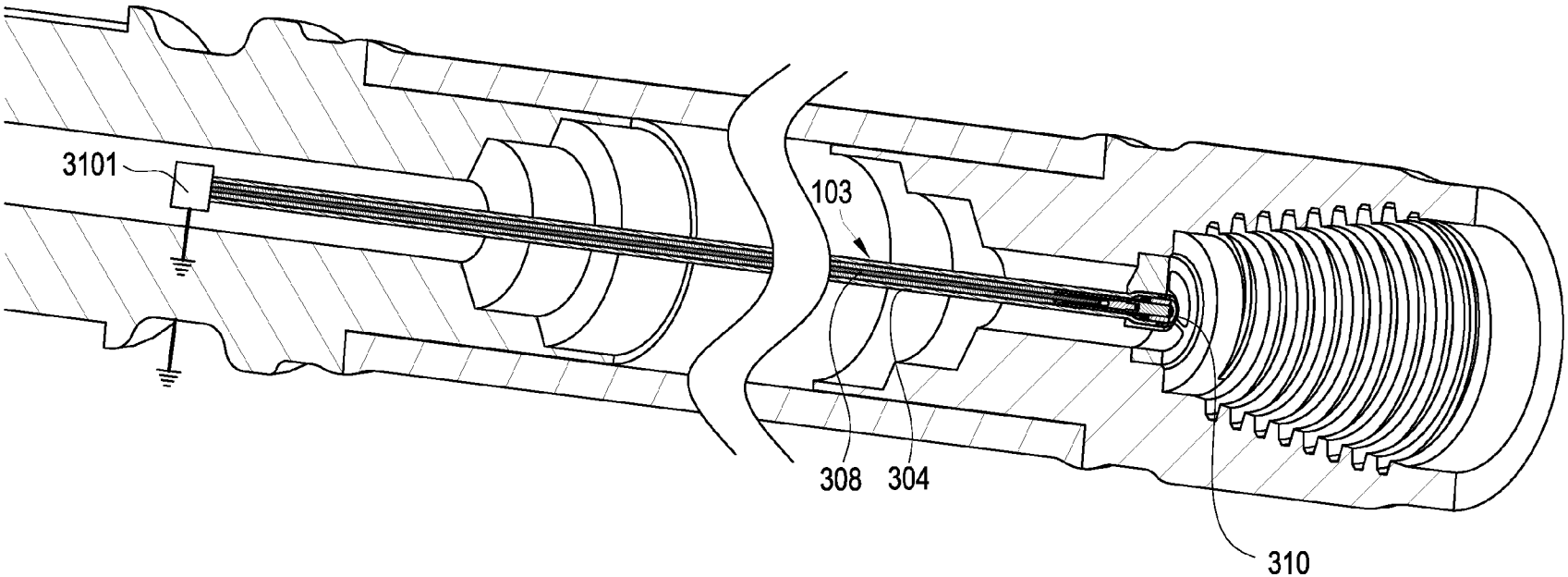
FIG. 31 is a cross-sectional diagram of another embodiment of an electrical conductor assembly disposed within a tubular body and in electrical communication with a downhole tool.

Referring now to FIG. 31, the electrical conductor assembly may be in communication with a downhole electronic device 3101 disposed within the tubular body 200. The downhole electronic device 3101 may be a power and/or data supply or source. Preferably the downhole electronic device 3101 is in direct electrical communication with the first conductor 308 of the electrical conductor assembly. The device 3101 may be for example a generator, a turbine, a sensor, a data logging module, an amplifier, a repeater, a motor, a hammer, or a combination thereof. Preferably the electronic device shares a ground connection with the electrical conductor assembly 103.

Figure 32:
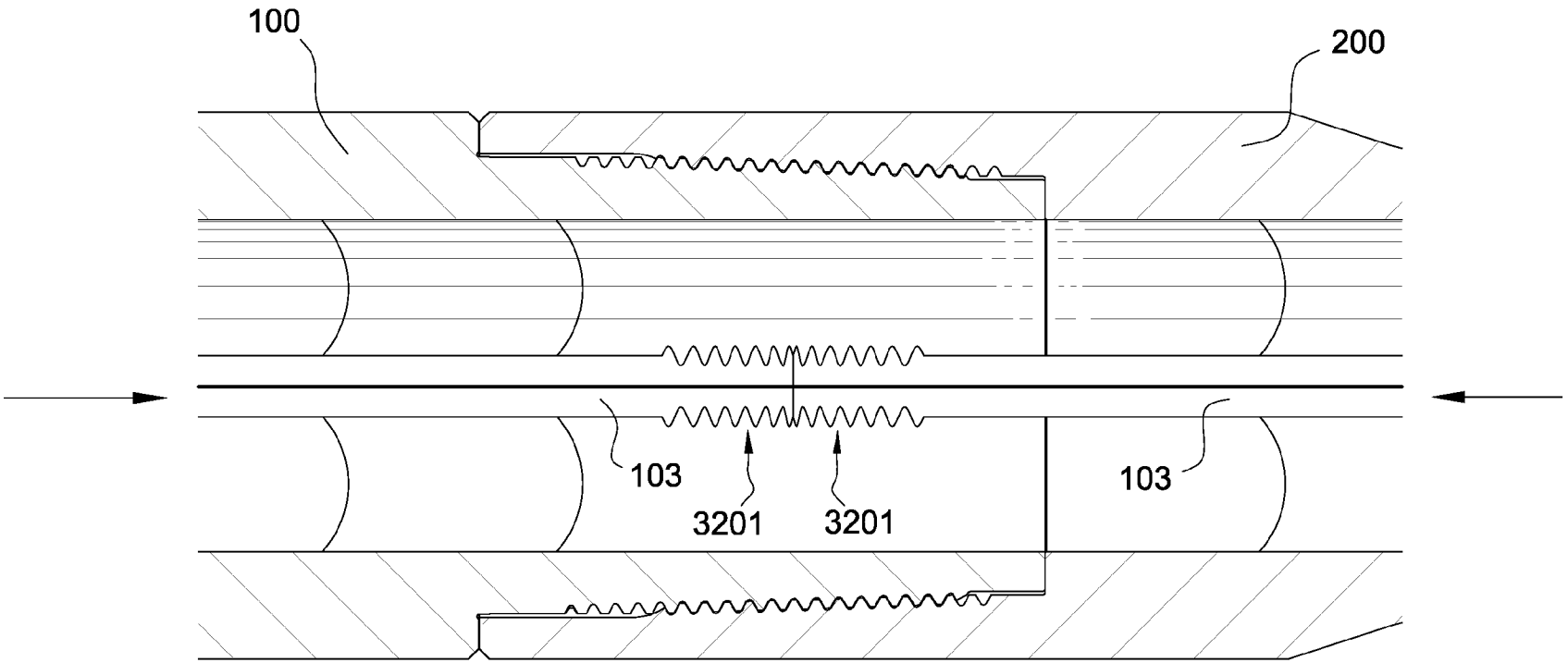
FIG. 32 is a cross-sectional diagram of another embodiment of mated electrical conductor assemblies disposed within two tubular bodies.

Referring now to FIG. 32, another embodiment of electrical conductor assemblies 103 may comprise spring-like resilient ends 3201 which compress upon being pressed together and serve to establish good electrical connectivity across the tool joint.

Figure 33:
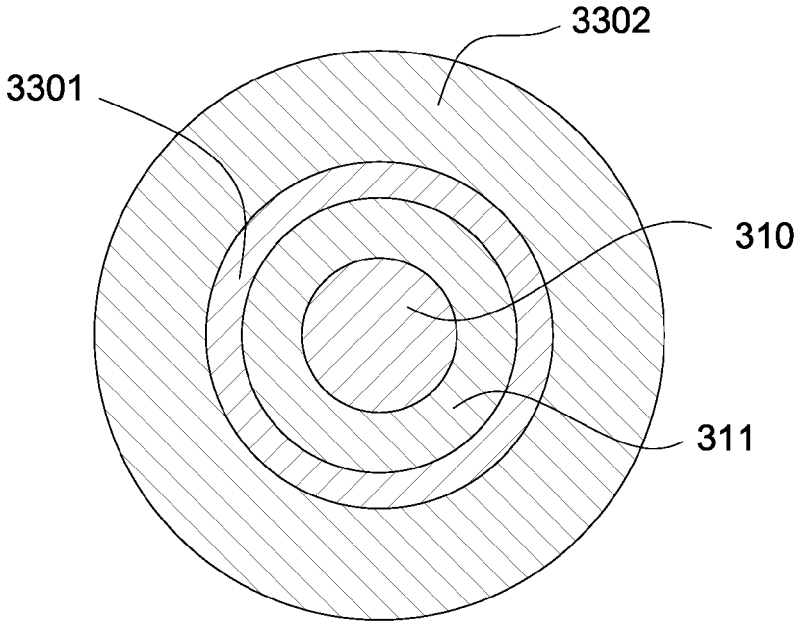
FIG. 33 is a cross-sectional diagram of another embodiment of a mating surface of an electrical conductor assembly.
Figure 34:
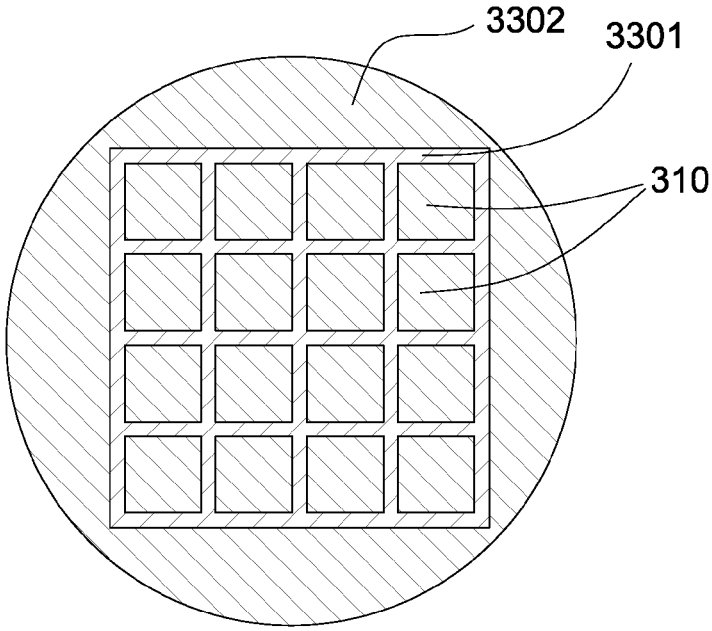
FIG. 34 is a cross-sectional diagram of another embodiment of a mating surface of an electrical conductor assembly.

Referring to FIGS. 33-34 different embodiments of the face of the mating surface 104 of the electrical conductor assembly 103 are shown. In FIG. 33 a first electrically conductive portion 310 is separated from a second electrically conductive portion 3301 by the dielectric material 311. The second electrically conductive portion 3301 is concentric and coaxial to the first electrically conductive portion 310 in this particular embodiment. A second portion of dielectric material 3302 may surround the second electrically conductive portion 3301. The first and second electrically conductive portions 310, 3301 may be in electrical communication to provide a backup signal transmission means or may be connected to separate conductors to increase bandwidth, for example.

Figure 35:
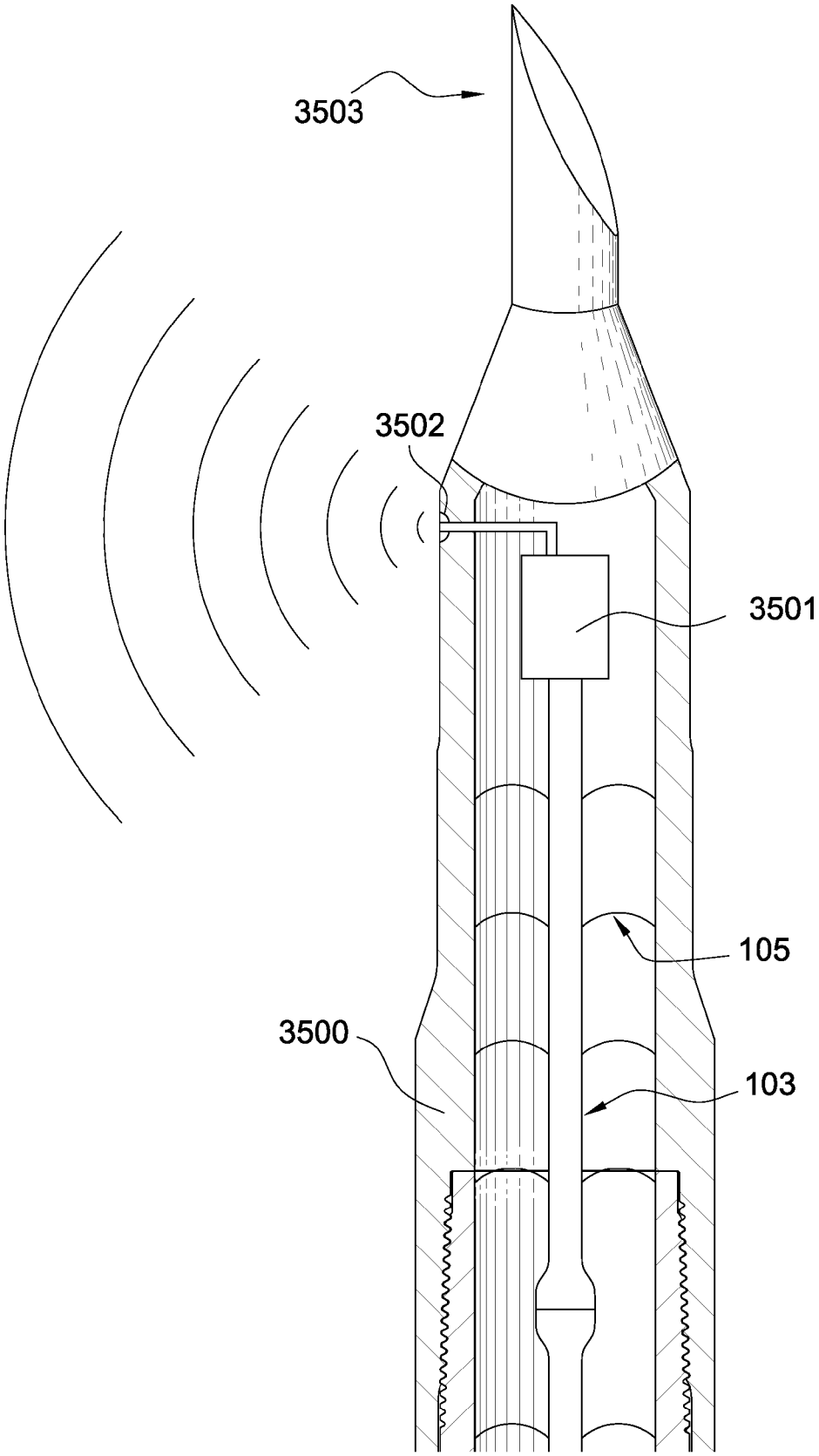
FIG. 35 is a cross-sectional diagram of an embodiment of a tool string head.

Referring now to FIG. 35, a tubular downhole tool 3500 is shown terminating a tool string. The tubular downhole tool 3500 may comprise a bit 3503 that permits the exit of drilling fluid as a formation is excavated or explored. The downhole tool 3500 comprises an electrical conductor assembly 103 with stabilizing elements 105 in accordance with aspects of the invention previously cited. The electrical conductor may provide power to a downhole electronic module 3501 such as a logging tool. The downhole electronic module 3501 may comprise an electromagnetic, nuclear, or acoustic energy source 3502 which may be used to characterize the physical nature of the formation.

Figure 36:
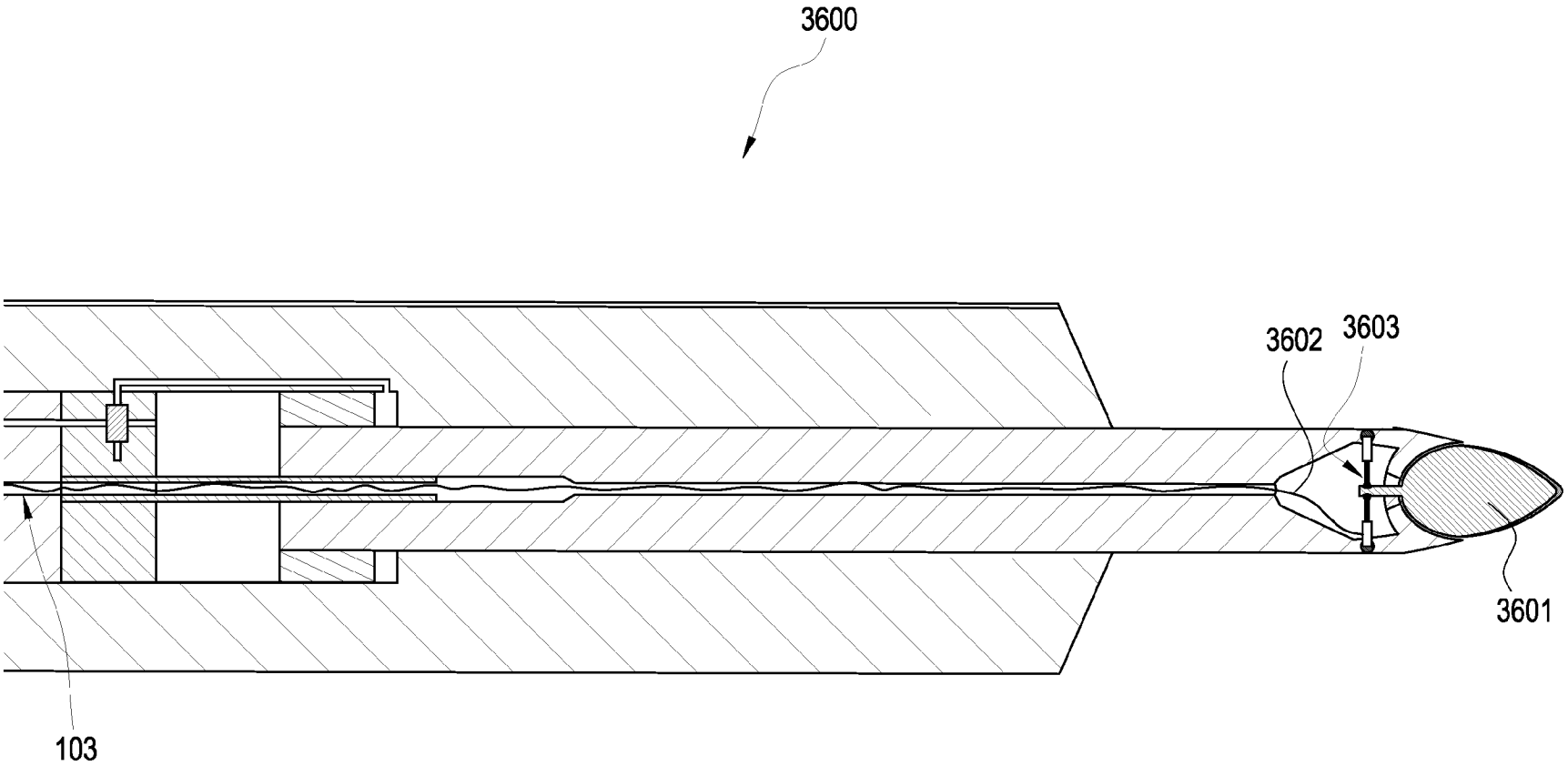
FIG. 36 is a cross-sectional diagram of another embodiment of a tool string head.
Figure 37:
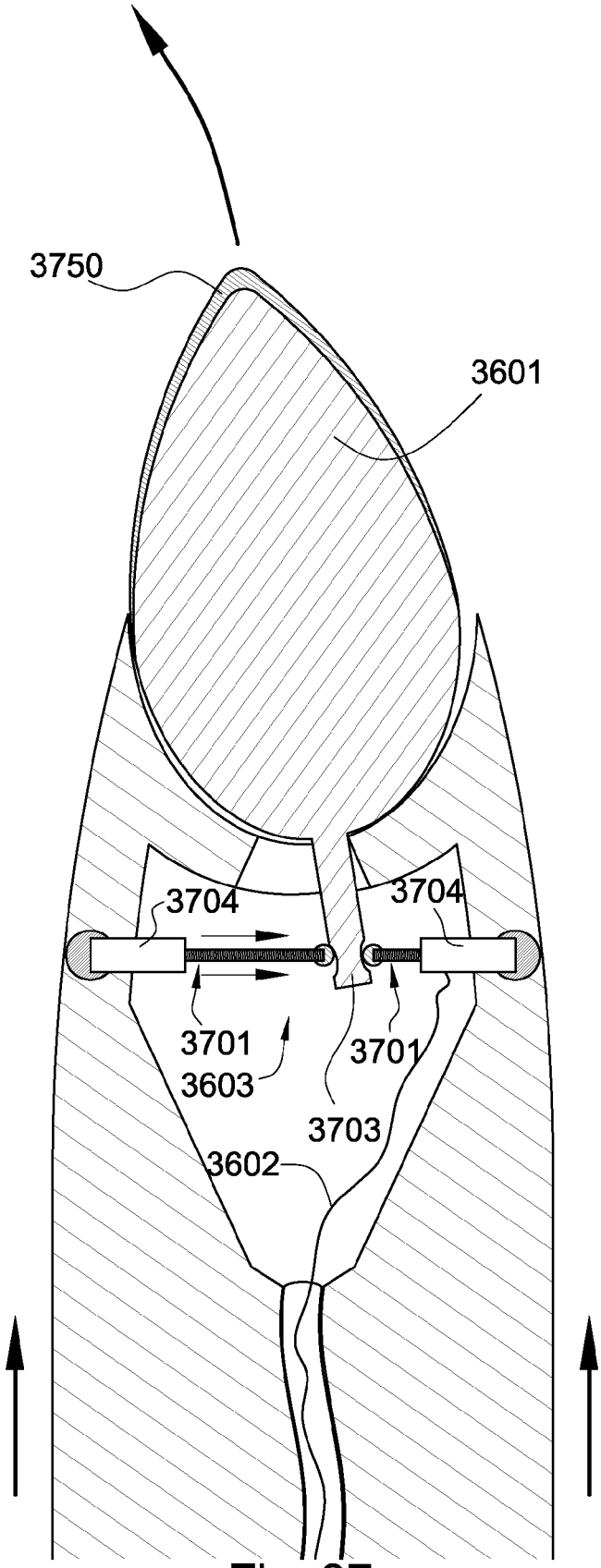
FIG. 37 is a cross-sectional diagram of another embodiment of a tool string head.

Referring now to FIGS. 36-37, the present invention may be used in conjunction with a burrowing element 3600 for steering a tool string. An electrical conductor assembly 103 may provide data and/or power to a steering element 3603 and a pointed head 3601 of the burrowing element 3600 through an electrical conductor 3602. As an electrical signal is received at the steering element 3603 motors 3704 may be used to turn threaded shafts 3701 to change the axial position of a steering rod 3703 in the pointed head 3601 and thus alter the angle of the pointed head 3601 to steer the burrowing element 3600 in a desired direction. The pointed head may comprise a wear resistant coating 3750 such as diamond or cubic boron nitride.

Figure 38:
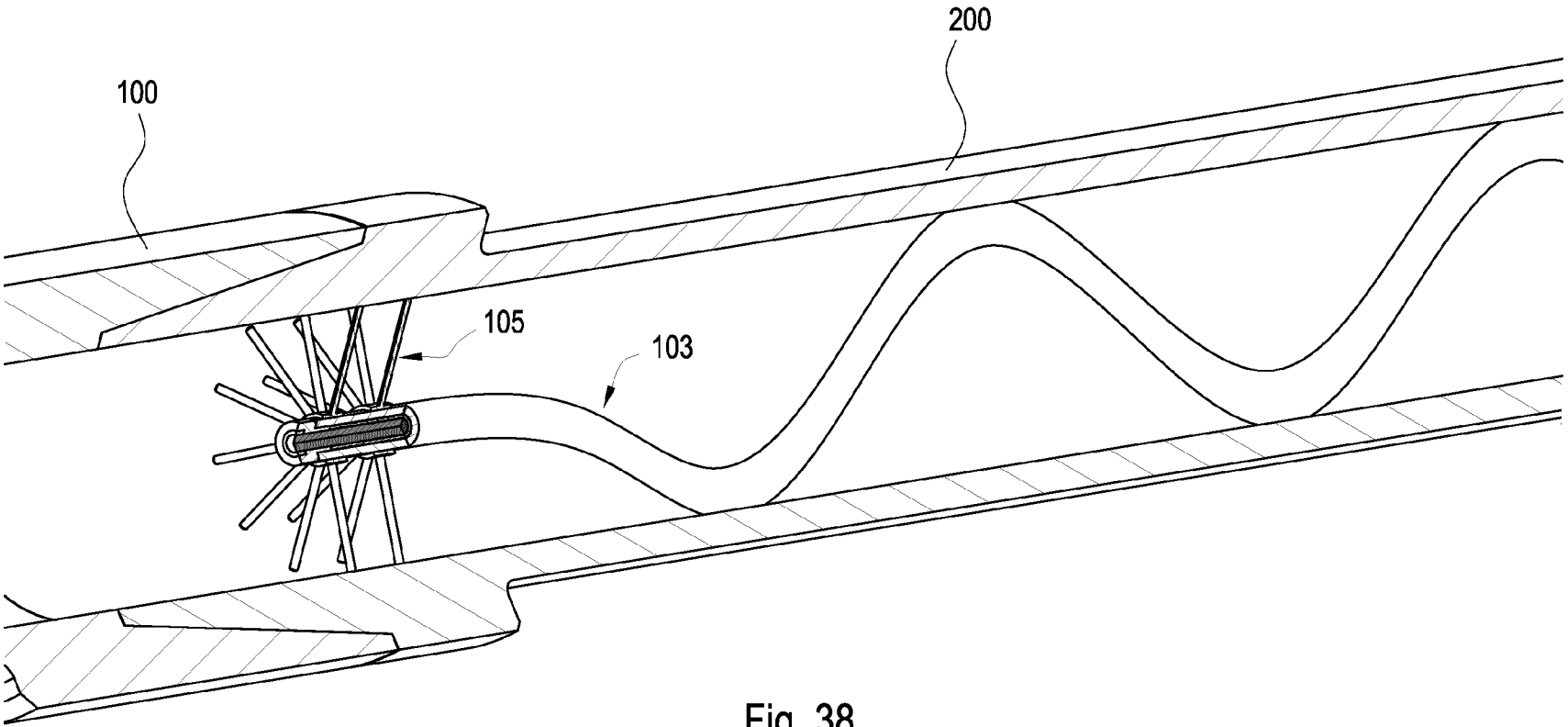
FIG. 38 is a cross-sectional diagram of another embodiment of an electrical conductor assembly disposed within an end of a tubular body.

Referring now to FIG. 38, it may be possible to add further stability and compressive strength to an embodiment of the present invention by disposing an electrical conductor assembly 103 with a spring configuration. For example, an electrical conductor assembly 103 comprising a length greater than that of the tubular body 200 may be buckled in a sinusoidal shape and provide an increased spring constant to the assembly 103.

Figure 39:
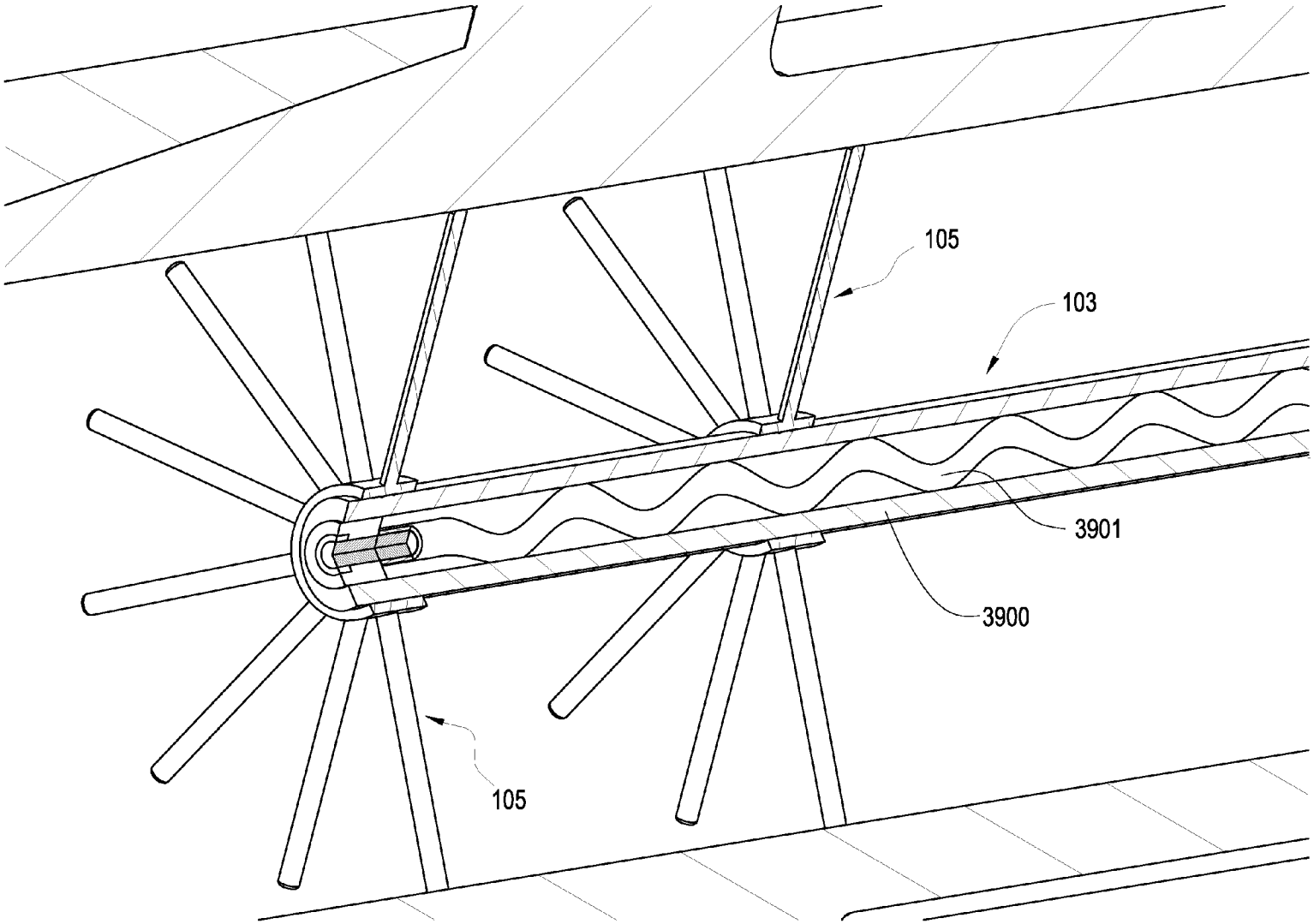
FIG. 39 is a cross-sectional diagram of another embodiment of an electrical conductor assembly disposed within an end of a tubular body.

Referring now to FIG. 39, another embodiment of the invention comprises an electrical conductor assembly 103 with a buckled coaxial cable 3901 disposed within a collar 3900. The buckled coaxial cable 3901 may comprise both the first conductor 308 and the second conductor 309. The buckled nature of the cable 3901 may provide a spring-loaded mating surface 104. The collar 3900 may be supported and centralized by the stabilizing elements. The collar 3900 may extend for substantially the entire length of the electrical conductor assembly or the collar may be segmented.

Whereas the present invention has been described in particular relation to the drawings attached hereto, it should be understood that other and further modifications apart from those shown or suggested herein, may be made within the scope and spirit of the present invention.

What is claimed is:

1. An apparatus comprising:

a downhole tubular body comprising a bore having a central axis;

an electrical conductor assembly disposed within the bore of the tubular component, the assembly comprising a first end, a second end, a first conductor extending from the first end to the second end, and a second conductor also extending from the first end to the second end and being electrically isolated from the first conductor;

at least one end of the assembly having a polished mating surface comprising an electrically conductive portion surrounded by a dielectric material exposed within the mating surface, the electrically conductive portion being in electrical communication with the first conductor;

wherein the first and second ends of the electrical conductor assembly are substantially aligned to the central axis of the bore by attached into stabilizing elements within the bore;

wherein at least one of the stabilizing elements is attached to a collar surrounding the electrical conductor assembly;

wherein at least one of the stabilizing elements is selected from the group consisting of fins, rings, wave springs, rods, bristles, beads, blocks, whiskers, plates and combinations thereof.

2. The component of claim 1, wherein the downhole tubular body is selected from the group consisting of drill pipe, drill collars, subs, horizontal drill pipes, reamers, production pipe, injection pipe, upset drill pipe, and combinations thereof.

3. The component of claim 1, wherein the mating surface is flat.

4. The component of claim 3, wherein the mating surface comprises a polished, hard surface.

5. The component of claim 1, wherein the electrically conductive portion of the mating surface comprises at least one material selected from the group consisting of tungsten carbide, beryllium copper, cemented metal carbide, hardened steel, and combinations thereof.

6. The component of claim 1, wherein the dielectric portion comprises a material selected from the group consisting of alumina, ferrite, polycrystalline diamond, carbon, and/or oxides of Mg, Al, Si, Yb, Ca, Be, Sr, Nd, Sm, Er, Eu, Sc, La, Gd, Dy, and Tm.

7. The component of claim 1, wherein the mating surface comprises a dimple.

8. The component of claim 1, wherein the mating surface comprises a junk slot.

9. The component of claim 1, wherein the mating surface is concave, convex, non-planar, or combinations thereof.

10. The component of claim 1, wherein the mating surface comprises a larger diameter than a remainder of the electrical conductor assembly.

11. The component of claim 1, wherein the mating surface comprises a second concentric electrically conducting portion.

12. The component of claim 1, wherein the electrical conductor assembly comprises a coaxial cable, a pair of twisted wires, insulated copper wires, or combinations thereof.

13. The component of claim 1, wherein the electrical conductor assembly further comprises a stainless steel armoring.

14. The component of claim 13, wherein the stainless steel armoring is flared on at least one end.

15. The component of claim 13, further comprising at least one seal intermediate the armoring and the dielectric material.

16. The component of claim 13, wherein the armoring is held in tension within the tubular component.

17. The component of claim 1, wherein resilient spring is in communication with the mating surface.

18. The component of claim 1, wherein the first electrical conductor is in electrical communication with a power source.

19. The component of claim 1, wherein the first electrical conductor is in electrical communication with a data source.

20. The component of claim 1, wherein the second electrical conductor is in electrical communication with the tubular body.

21. The component of claim 1, wherein the stabilizing elements are attached directly to the electrical conductor assembly.

22. The component of claim 1, wherein the stabilizing elements are under an axially compressive load.

23. The component of claim 1, wherein the electrically conductive portion of the mating surface is coupled to the first electrical conductor by an electrically conductive interface.

24. The component of claim 1, wherein a portion of the electrically conductive interface intermediate the mating surface and the first electrical conductor is covered by an electrical insulator.

* * * * *